US008691486B2

(12) United States Patent
Inoue et al.

(10) Patent No.: US 8,691,486 B2
(45) Date of Patent: Apr. 8, 2014

(54) ELECTROSTATIC IMAGE DEVELOPING TONER, DEVELOPER, IMAGE FORMING APPARATUS, IMAGE FORMING METHOD, AND PROCESS CARTRIDGE

(75) Inventors: Ryota Inoue, Shizuoka (JP); Akihiro Kotsugai, Shizuoka (JP); Akiyoshi Sabu, Shizuoka (JP); Shingo Sakashita, Shizuoka (JP); Yukiko Nakajima, Shizuoka (JP); Keiko Osaka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 671 days.

(21) Appl. No.: 12/824,688

(22) Filed: Jun. 28, 2010

(65) Prior Publication Data

US 2010/0330489 A1 Dec. 30, 2010

(30) Foreign Application Priority Data

Jun. 30, 2009 (JP) ..... 2009-154499

(51) Int. Cl.
*G03G 9/00* (2006.01)

(52) U.S. Cl.
USPC ..... 430/109.1; 430/109.3; 430/109.4; 430/110.1; 430/110.2; 430/124.1

(58) Field of Classification Search
USPC ..... 430/108.4, 124.1, 109.1, 109.3, 109.4, 430/110.1, 110.2
See application file for complete search history.

(56) References Cited

U.S. PATENT DOCUMENTS

| | | | | |
|---|---|---|---|---|
| 5,238,767 | A * | 8/1993 | Horiie | 430/108.11 |
| 6,821,698 | B2 * | 11/2004 | Sawada et al. | 430/108.4 |
| 7,879,440 | B2 * | 2/2011 | Yatsuzuka et al. | 428/327 |
| 2007/0015077 | A1 * | 1/2007 | Yamashita et al. | 430/109.4 |
| 2008/0227002 | A1 | 9/2008 | Moriya et al. | |
| 2009/0003885 | A1 | 1/2009 | Sabu et al. | |
| 2010/0104965 | A1 | 4/2010 | Inoue et al. | |
| 2010/0183967 | A1 * | 7/2010 | Sabu et al. | 430/107.1 |

FOREIGN PATENT DOCUMENTS

| | | | |
|---|---|---|---|
| EP | 1 744 222 | A2 | 1/2007 |
| EP | 1 744 222 | A3 | 1/2007 |
| JP | 59-96123 | | 6/1984 |
| JP | 7-33861 | | 2/1995 |
| JP | 9-274335 | | 10/1997 |
| JP | 9-319144 | | 12/1997 |
| JP | 2909873 | | 4/1999 |
| JP | 2001-166537 | | 6/2001 |
| JP | 2002-284881 | | 10/2002 |
| JP | 3640918 | | 1/2005 |
| JP | 2007-33716 | A | 2/2007 |
| JP | 2008-262179 | | 10/2008 |
| JP | 2009-37206 | A | 2/2009 |

* cited by examiner

*Primary Examiner* — Thorl Chea
(74) *Attorney, Agent, or Firm* — Oblon, Spivak, McClelland, Maier & Neustadt, L.L.P.

(57) ABSTRACT

An electrostatic image developing toner including a toner particle (C), wherein the toner particle (C) has a structure in which a resin particle (A) containing at least a first resin (a) or a coated film (P) containing the first resin (a) is attached to a surface of a resin-containing particle (B) containing a second resin (b), and wherein the resin (b) includes a polyhydroxy-carboxylic acid skeleton, and the resin (a) is a polyester resin containing a polybasic acid and a polyhydric alcohol.

17 Claims, 2 Drawing Sheets

ELECTROSTATIC IMAGE DEVELOPING TONER, DEVELOPER, IMAGE FORMING APPARATUS, IMAGE FORMING METHOD, AND PROCESS CARTRIDGE

BACKGROUND OF THE INVENTION

1. Field of the Invention

The present invention relates to an electrostatic image developing toner for use in electrophotographic image formation using copiers, electrostatic printing, printers, facsimiles, electrostatic recording, etc., and a developer using the toner, an image forming apparatus, an image forming method and a process cartridge each using the toner.

2. Description of the Related Art

Conventionally, in electrophotographic image forming apparatuses, electrostatic recording apparatuses, etc., electric or magnetic latent images are formed into visible images with toners. For example, in an electrophotographic image formation process operation, an electrostatic image (a latent image) is formed on a photoconductor and then developed thereon using a toner to form a toner image. The toner image is transferred, generally, onto a recording medium such as paper, and then fixed on the recording medium by heating or the like.

Toners for use in developing of electrostatic images are generally colored particles containing a colorant, a charge controlling agent and the like in a binder resin. The production methods of such toners are broadly classified into pulverization methods and suspension polymerization methods.

In the pulverization method, a colorant, a charge controlling agent, an offset preventing agent and the like are uniformly dispersed in a thermoplastic resin by melt-mixing to obtain a toner composition. Then, the toner composition thus obtained is pulverized and subsequently classified, thereby producing a toner. According to the pulverization method, it is possible to produce a toner excellent in physical properties to some extent, however, the selection of materials is limited. For example, a toner composition obtained by melt-mixing needs to be able to be pulverized and classified by an economically usable device. To respond to the demand, the toner composition obtained by melt-mixing must be made brittle. When such a toner composition is pulverized, particles having a broad particle size distribution are likely to be formed. At this time, in an attempt to obtain a copied image having excellent resolution and gradation, for example, fine particles each having a particle diameter of 5 μm or less and coarse particles each having a diameter of 20 μm or more must be eliminated by classifying the toner particles, thereby causing substantially low toner yield. In addition, in the pulverization method, it is hard to uniformly disperse a colorant and a charge controlling agent and the like in a thermoplastic resin. A dispersion solution in which these components are insufficiently dispersed adversely affects flowability developing property and durability of the resulting toner, image quality, and the like.

In order to overcome the problems in the pulverization method, Japanese Patent Application Laid-Open (JP-A) Nos. 09-319144 and 2002-284881 propose toner production methods through a dissolution suspension method using a dissolved resin (hereinbelow, otherwise referred to as "resin-dissolution-suspension method"). This dissolved resin is preliminarily synthesized by a polymerization reaction and later dissolved in a liquid to prepare a resin solution, which is dispersed in an aqueous medium in the presence of a surfactant or a dispersing auxiliary (a water-soluble resin, etc.) and a dispersion stabilizer (inorganic fine particles, resin fine particles, etc.), followed by heating, or reduction of pressure or the like, to remove solvents therein. The resin-dissolution-suspension method enables production of a toner having a uniform particle size, without the need for classification of the resin dispersion liquid.

In addition, in electrophotographic image forming apparatuses, toners are required to have good releasability (hereinbelow, otherwise referred to as "offset resistance") from heating members during a fixing step based on a contact-heating process in which a heating member such as a heating roller is used to fix an image. An improvement of the offset resistance of a toner prepared by the resin-dissolution-suspension method is achieved by using a modified polyester resin (see Japanese Patent (JP-B) No. 3640918).

Meanwhile, most of binder resins accounting for 70% or more of the total amounts of toner components are derived from petroleum resources. There are concerns about exhaustion of petroleum resources and concerns that a large amount of petroleum resources is consumed and a large quantity of carbon dioxide is released into the atmosphere, leading to global-warming. Then, when resins derived from plants taking in carbon dioxide in the atmosphere to grow are used as binder resins, carbon dioxide generated in use of the toners only circulates in the environments, and the use of plant-derived resins may make it possible to simultaneously solve both problems of global-warming and the exhaustion of petroleum resources. A variety of toners using such plant-derived resins as binder resins have been proposed. For example, Japanese Patent (JP-B) No. 2909873 proposes to use a polylactic acid as a binder resin. However, when a polylactic acid is directly used as a binder resin according to the proposal, the concentration of ester linkage of the binder resin is higher than that of a polyester resin, and thus, the effect as a thermoplastic resin becomes weak in fixing step of toner image. Moreover, the toner becomes very hard, lacking in pulverizability, and resulting in degradation of productivity. Furthermore, the toner becomes very hard, lacking in pulverizability, and resulting in degradation of productivity.

Japanese Patent Application Laid-Open (JP-A) No. 09-274335 proposes an electrostatic image developing toner, which contains a polyester resin obtained by dehydration polycondensation of a composition containing a lactic acid, and a trifunctional or higher-functional oxycarboxylic acid, and a colorant. However, in this proposal, since the polyester resin is formed by a dehydration polycondensation reaction between a hydroxyl group of the lactic acid and a carboxyl group of the oxycarboxylic acid, the molecular weight is increased, thereby causing impairment of the sharp-melt property and low-temperature fixability.

In order to improve thermal properties of toner, Japanese Patent Application Laid-Open (JP-A) No. 2001-166537 discloses an electrophotographic toner containing a polylactic acid-based biodegradable resin and a terpene-phenol copolymer, which however, cannot satisfy both the low-temperature fixability and the hot-offset property simultaneously.

Since the toners relating to these proposals are obtainable by a pulverization method, it involves problems of toner loss caused by classification, and toner waste accompanied therewith. In addition, because the energy quantity required for performing the pulverization method is relatively large, it is necessary to further reduce environmental load.

Polylactic acids, which are generally used and easily available as resins derived from plants, are synthesized by dehydration condensation of a lactic acid, as described in Japanese Patent Application Laid-Open (JP-A) Nos. 07-33861 and 59-96123, or by ring-opening polymerization of a cyclic lactide of lactic acid. For this reason, when a toner is produced using a polylactic acid, the dissolution suspension method using a dissolved resin, as disclosed in Japanese Patent Application Laid-Open (JP-A) Nos. 09-319144, 2002-284881 and Japanese Patent (JP-B) No. 3640918, can be used. However, since a polylactic acid having only L form or D form has high crystallinity, the solubility in organic solvents is extremely low, and thus it is difficult to use dissolution suspension method using a dissolved resin. To overcome the problem, Japanese Patent Application Laid-Open (JP-A) No. 2008-262179 discloses that the solubility of lactic acid in organic solvents can be improved by mixing L form of a polylactic acid and D form of a polylactic acid to decrease the crystallinity.

On the other hand, since it is difficult to control the molecular weights of polylactic acids, and ester linkages are present via only carbon atoms, it is difficult to impart necessary physical properties to toner by using polylactic acid along. In contrast, as used in conventional methods, it can be considered to provide necessary physical properties and thermal properties to toner by using a mixture of a polylactic acid and other resin or resins. However, polylactic acids are extremely poor in solubility and dispersibility in polyester resins and styrene-acryl copolymers which are generally used for toner, and thus it is very difficult to produce a toner in such a manner.

Furthermore, since the rate of crystallization of polylactic acids is rather slow, a toner produced by dissolution suspension method using a dissolved resin is difficult to control the crystallized state of polylactic acid, and in a toner produced by the method, a polylactic acid having high-crystallinity and a polylactic acid having low-crystallinity are present in a mixed manner. Therefore, portions having the high-crystalline polylactic acid are grown into crystals over time, causing changes in charged amount and image density of the resulting toner as time goes by.

Further, polylactic acid has a number of polar groups per unit structure, and thus when a toner is produced using a polylactic acid whose crystallinity has been reduced, the resulting toner is largely influenced by humidity as compared with using a polylactic acid having high crystallinity. Therefore, it is difficult to control the charged amount of toner. Particularly, it is difficult to reduce variations in charged amount under low-temperature and low-humidity conditions, and high-temperature and high-humidity conditions. For this reason, in use of polylactic acids, there are such drawbacks that the charged amount and the image density are unstable.

Accordingly, a toner which are superior in image density, haze degree, fixability, and heat-resistant storage stability, causes less changes in fixability with a lapse of time and contains a polylactic acid, and the related techniques have not yet been obtained, and further improvements and developments are still desired.

BRIEF SUMMARY OF THE INVENTION

The present invention has been made in light of the present situation to overcome the above-mentioned conventional problems. An object of the present invention is to provide a toner which is superior in low-temperature fixability while maintaining excellent hot-offset resistance and which makes it possible to obtain images excellent in image density, haze degree and environmental variability, even when a polylactic acid is used, and to provide a developer having such excellent physical properties.

As a result of carrying out extensive studies and examinations in an attempt to solve the aforesaid problems, the present inventors have completed the present invention. The following are embodiments of the present invention.

<1> An electrostatic image developing toner consisting of:

a toner particle (C), wherein the toner particle (C) has a structure in which a resin particle (A) containing at least a first resin (a) or a coated film (P) containing the first resin (a) is attached to a surface of a resin-containing particle (B) containing a second resin (b), and wherein the resin (b) includes a polyhydroxycarboxylic acid skeleton, and the resin (a) is a polyester resin.

<2> The electrostatic image developing toner according to <1>, wherein the polyester resin contains a polybasic acid and a polyhydric alcohol, and the polybasic acid is at least one of an aromatic dicarboxylic acid, an aliphatic dicarboxylic acid and an alicyclic dicarboxylic acid.

<3> The electrostatic image developing toner according to <2>, wherein the aromatic dicarboxylic acid is selected from terephthalic acid, isophthalic acid, orthophthalic acid, naphthalene dicarboxylic acid, and biphenyl dicarboxylic acid.

<4> The electrostatic image developing toner according to one of <2> and <3>, wherein the aliphatic dicarboxylic acid is selected from oxalic acid, succinic acid, succinic anhydride, adipic acid, azelaic acid, sebacic acid, dodecanedioic acid, hydrogenated dimer acid, fumaric acid, maleic acid, maleic anhydride, itaconic acid, itaconic anhydride, citraconic acid, citraconic anhydride, and dimer acid.

<5> The electrostatic image developing toner according to any one of <2> to <4>, wherein the alicyclic dicarboxylic acid is selected from 1,4-cyclohexanedicarboxylic acid, 1,3-cyclohexanedicarboxylic acid, 1,2-cyclohexanedicarboxylic acid, 2,5-norbornenedicarboxylic acid, 2,5-norbornenedicarboxylic anhydride, tetrahydrophthalic acid, and tetrahydrophthalic anhydride.

<6> The electrostatic image developing toner according to any one of <1> to <5>, wherein the polyester resin contains a polybasic acid and a polyhydric alcohol, and the polyhydric alcohol is at least one of an aliphatic glycol having 2 to 10 carbon atoms, an alicyclic glycol having 6 to 12 carbon atoms, and an ether bond-containing glycol.

<7> The electrostatic image developing toner according to any one of <1> to <6>, wherein the resin (b) includes a polyhydroxycarboxylic acid skeleton derived from an optically active monomer, the polyhydroxycarboxylic acid skeleton has an optical purity X, calculated on the monomer basis, of 80% or less, and the optical purity X is determined from the following equation, $$\text{Optical Purity } X(\%)=|X(L\text{-form})-X(D\text{-form})|$$

where X (L-form) represents, calculated on the monomer basis, an L form ratio (mol %), and X (D-form) represents, calculated on the monomer basis, a D form ratio (mol %).

<8> The electrostatic image developing toner according to any one of <1> to <7>, wherein the polyhydroxycarboxylic acid skeleton contained in the resin (b) is a skeleton obtained by polymerization or copolymerization of a lactic acid.

<9> The electrostatic image developing toner according to any one of <1> to <7>, wherein the polyhydroxycarboxylic acid skeleton contained in the resin (b) is a skeleton obtained by ring-opening polymerization of lactide.

<10> The electrostatic image developing toner according to any one of <1> to <7>, wherein the polyhydroxycarboxylic acid skeleton contained in the resin (b) is a skeleton obtained by ring-opening polymerization of a mixture of L-lactide and D-lactide.

<11> The electrostatic image developing toner according to any one of <1> to <7>, wherein the polyhydroxycarboxylic acid skeleton contained in the resin (b) is a skeleton obtained by copolymerization of a hydroxycarboxylic acid having 2 to 6 carbon atoms.

<12> The electrostatic image developing toner according to <11>, wherein the hydroxycarboxylic acid having 2 to 6 carbon atoms is any one of glycolic acid, lactic acid, glycolide, and lactide.

<13> The electrostatic image developing toner according to any one of <1> to <12>, wherein the resin (b) contains a linear polyester (b1) obtained by reacting a polyester diol (b11) containing a polyhydroxycarboxylic acid skeleton with a polyester diol (b12) other than the polyester diol (b11) in the presence of a chain-extending agent.

<14> The electrostatic image developing toner according to <13>, wherein a mass ratio of the polyester diol (b11) to the polyester diol (b12) is 31:69 to 90:10.

<15> The electrostatic image developing toner according to any one of <1> to <14>, wherein the resin (b) contains the linear polyester resin (b1) and a resin (b2) obtainable by reaction of a precursor (b0) in formation of the toner particle (C).

<16> The electrostatic image developing toner according to any one of <1> to <15>, wherein the polyester resin of the first resin (a) has an acid value of 10 mgKOH/g to 40 mgKOH/g.

<17> The electrostatic image developing toner according to any one of <1> to <16>, wherein the first resin (a) is a polyester resin containing a basic compound.

<18> A developer including:

the electrostatic image developing toner according to any one of <1> to <17>, and a carrier.

<19> An image forming apparatus including:

a latent electrostatic image-bearing member, a charging unit configured to charge a surface of the latent electrostatic image-bearing member, an exposing unit configured to expose the charged surface of the latent electrostatic image-bearing member to form a latent electrostatic image, a developing unit configured to develop the latent electrostatic image using a developer to form a visible image, a transfer member configured to transfer the visible image onto a recording medium, and a fixing unit configured to fix the transferred image on the recording medium, wherein the developer is the developer according to <18>.

<20> An image forming method including:

charging a surface of a latent electrostatic image-bearing member, exposing the charged surface of the latent electrostatic image-bearing member to form a latent electrostatic image, developing the latent electrostatic image using a developer to form a visible image, transferring the visible image onto a recording medium, and fixing the transferred image on the recording medium, wherein the developer is the developer according to <18>.

<21> A process cartridge including:

a latent electrostatic image-bearing member, and a developing unit configured to develop a latent electrostatic image formed on the latent electrostatic image-bearing member using a developer to form a visible image, wherein the process cartridge is detachably mounted to the main body of the image forming apparatus, wherein the developer is the developer according to <18>.

The toner of the present invention is superior in the low-temperature fixability while maintaining hot offset resistance and is effectively used to form an image excellent in image density, haze degree and environmental variability.

DETAILED DESCRIPTION OF THE INVENTION

Figure 1:
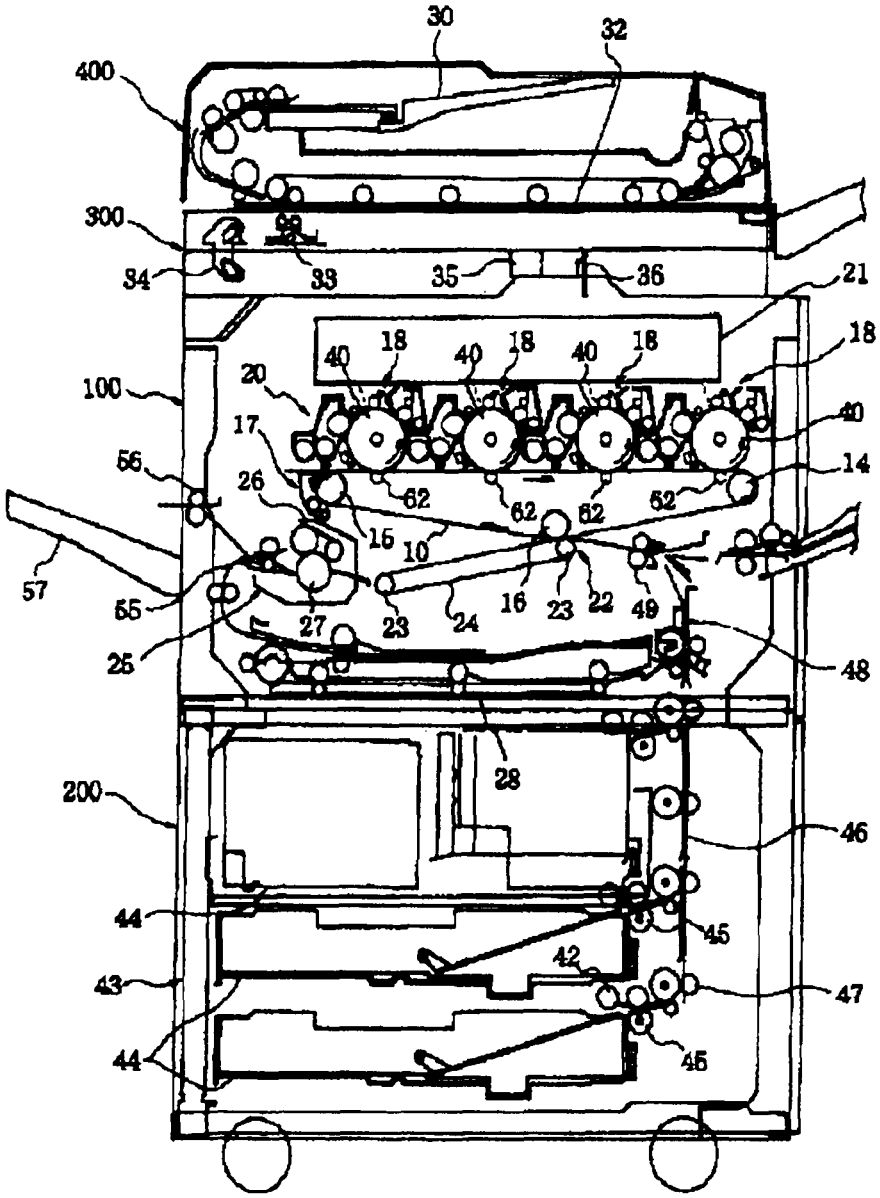
FIG. 1 is a diagram illustrating one example of an image forming apparatus according to the present invention.

A toner particle (C) constituting a toner of the present invention has one of the following structures (1) and (2):

(1) A structure where a resin particle (A) containing at least a first resin (a) is attached to a surface of a resin-containing particle (B) containing a second resin (b).

(2) A structure where a coated film (P) containing the first resin (a) is attached to a surface of the resin-containing particle (B) containing the second resin (b).

Here, the description "attached to a surface of the resin-containing particle (B)" means that the resin particle (A), which is a fine particle having a smaller particle diameter than that of the resin particle (B), is in a state of being sparsely attached to the surface of the resin-containing particle (B) to a state of being densely fused and attached, in the form of a film (i.e., coated film (P)), to the surface of the resin-containing particle (B). Such a state can be determined using SEM images etc.

In addition, in the toner of the present invention, the resin (a) is a polyester resin and includes a polybasic acid and a polyhydric alcohol, and the resin (b) includes a polyhydroxycarboxylic acid skeleton.

The resin (b) has a polyhydroxycarboxylic acid skeleton containing an optically active monomer. The polyhydroxycarboxylic acid skeleton is a skeleton obtained by polymerization of a hydroxycarboxylic acid and can be formed by directly dehydration-condensating a hydroxycarboxylic acid or by ring-opening polymerizing a corresponding cyclic ester. From the perspective that the molecular weight of a polyhydroxycarboxylic acid can be made greater by polymerization methods, it is preferred to employ the ring-opening polymerization.

Examples of the hydroxycarboxylic acid include aliphatic hydroxycarboxylic acids (glycolic acid, lactic acid, hydroxy butanoic acid, etc.); aromatic hydroxycarboxylic acids (salicylic acid, creosote acid, mandelic acid, valine acid, etc.); or mixtures thereof. Examples of the corresponding cyclic ester include glycolide, lactide, γ-butyrolactone, and 6-valerolactone.

Among these, from the perspective of transparency and thermal properties of the toner particle (C), as a monomer forming a polyhydroxycarboxylic acid skeleton, preferred are aliphatic hydroxycarboxylic acids; still more preferred are hydroxycarboxylic acids having 2 to 6 carbon atoms; even more preferred are glycolic acids, lactic acids, glycolides, and lactides; and most preferred are glycolic acids and lactic acids.

As materials of polymer other than hydroxy carboxylic acids, cyclic esters of hydroxy carboxylic acids can also be used. In this case, a hydroxycarboxylic acid skeleton of the resin obtainable by polymerization has a structure in which the hydroxycarboxylic acid constituting the cyclic ester is polymerized. For example, a polyhydroxycarboxylic acid skeleton of the resin obtainable by using lactide has a structure in which the lactic acid is polymerized.

When the monomer forming a polyhydroxycarboxylic acid skeleton is an optically active monomer like a lactic acid, an optical purity X (%), i.e., a value obtained by subtracting X (D-form) from X (L-form), Optical Purity X(%)=|X(L form)−X (D form)|, when expressed in terms of mole percents of monomer components, is preferably 80% or less, and more preferably 60% or less, with the proviso that X (L form) represents a ratio of L form (%), expressed in terms of an optically active monomer converted amount, and X (D form) represents a ratio of D form (%), expressed in terms of an optically active monomer converted amount. When the optical purity X (%) is within the above range, the solubility to solvents and crystallinity of the resin can be improved, and the after-mentioned preferred toner production method (I) can be readily applied thereto.

When the resin (b) is used in a toner which includes a pigment and wax, the pigment and wax are uniformly dispersed in the resin (b), and the image density and haze degree of the resulting toner can be improved because of high transparency of the resin (b).

In the present invention, the resin (b) preferably includes a linear polyester resin (b1) which is obtained by reaction of a polyester diol (b11) containing a polyhydroxycarboxylic acid skeleton, with a polyester diol (b12) other than the polyester diol (b11), in the presence of a chain extending agent. A linear polyester has a simple structure, and the molecular weight and physical properties (thermal properties and solubility with other resins) derived therefrom can be easily controlled. In addition, the linear polyester resin (b1) of the present invention is composed of a unit of (b11) and (b12) and has an advantage in that physical properties thereof can be controlled by the type of polyester used in the unit (b12), the molecular weight and the structure thereof, and is characterized by being definitely provided with physical property-controllability as compared to conventional compositions containing lactic acid(s).

To obtain a linear polyester, the (b11), (b12) and chain extending agent are respectively required to have two functional groups. When any one of these is trifunctional or more polyfunctional, it is impossible to obtain a linear polyester because a crosslinking reaction proceeds.

In formation of the polyhydroxy carboxylic acid skeleton, the after-mentioned diol (11) is added for copolymerization, thereby the polyester diol (b11) having a polyhydroxycarboxylic acid skeleton can be obtained. Preferred diols are 1,2-propylene glycol, 1,3-propylene glycol, 1,4-butane diol, 1,6-hexane diol, alkylene oxide adducts (the added mole number: 2 to 30) of bisphenols (bisphenol A, bisphenol F, bisphenol S, etc.) (hereinbelow, "alkylene oxide" is simply abbreviated as "AO"; specific examples thereof are ethylene oxide (hereinbelow, abbreviated as "EO"), propylene oxide (hereinbelow, abbreviated as "PO"), butylene oxide (hereinbelow, abbreviated as "BO"), etc.) and combinations thereof. More preferred diols are 1,2-propylene glycol, 1,3-propylene glycol, 1,4-butane diol, and AO adducts of bisphenol A. Even more preferred diol is 1,3-propylene glycol.

As the polyester diol (b12) other than (b11), it is possible to use, from among the after-mentioned polyester resins, a polyester resin equivalent to a reaction product between a diol (11) and a dicarboxylic acid (13), and the reaction product can be obtained by adjusting the charging ratio of the diol and the dicarboxylic acid in the polymerization process so as to increase the number of hydroxyl groups. Preferred polyester diol (b12) are 1,2-propylene glycol, 1,3-propylene glycol, 1,4-butane diol, 1,6-hexane diol, AO (EO, PO, BO, etc.) adducts (the added mole number: 2 to 30) of bisphenols (bisphenol A, bisphenol F, bisphenol S, etc.), and reaction products between one or more types of diols selected from the combinations thereof and one or more types of dicarboxylic acids selected from terephthalic acids, isophthalic acids, adipic acids, succinic acids and combinations thereof.

The number average molecular weight (hereinafter, abbreviated as "Mn") of the diols (b11) and (b12) is preferably 500 to 30,000, more preferably 1,000 to 20,000, and most preferably 2,000 to 5,000, from the viewpoint of controlling physical properties of the linear polyester resin (b1).

A chain extending agent used for chain extension of the polyester diol (b11) and the polyester diol (b12) is not particularly limited, as long as it has two functional groups which are reactable with hydroxyl groups contained in the polyester diol (b11) and the polyester diol (b12). For example, two functional groups of the after-mentioned dicarboxylic acids (13), anhydrides thereof, polyisocyanates (15) and polyepoxides (19) are exemplified. Of these, from the viewpoint of mutual solubility between the polyester diol (b11) and the polyester diol (b12), preferred are diisocyanate compounds, and dicarboxylic acid compounds. More preferred are diisocyanate compounds. Specific examples of the chain extending agent include succinic acid, adipic acid, maleic acid and anhydrides thereof, fumaric acid and anhydrides thereof, phthalic acid, isophthalic acid, terephthalic acid, 1,3- and/or 1,4-phenylene diisocyanate, 2,4- and/or 2,6-tolylene diisocyanate (TDI), 2,4'- and/or 4,4'-diphenylmethane diisocyanate (MDI), hexamethylene diisocyanate (HDI), dicyclohexyl methane-4,4'-diisocyanate (hydrogenerated MDI), isophorone diisocyanate (IPDI), and diglycidyl ether of bisphenol A. Among these, preferred are succinic acid, adipic acid, isophthalic acid, terephthalic acid, maleic acid (anhydrides thereof), fumaric acid (anhydrides thereof), HDI, and IPDI. Most preferred are maleic acid (anhydride thereof), fumaric acid (anhydride thereof), and IPDI.

The amount of the chain extending agent in the linear polyester resin (b1) is preferably 0.1% by mass to 30% by mass, and more preferably 1% by mass to 20% by mass, from the viewpoint of the transparency and thermal properties.

The amount of the linear polyester resin (b1) contained in the resin (b) is optionally controlled in a preferred range depending on the application. It is, however, preferably 40% by mass to 100% by mass, and more preferably 60% by mass to 90% by mass relative to the total amount of binder resin from the viewpoint of the transparency and thermal properties. Even when the hydroxycarboxylic acid contained in the liner polyester resin (b1) is an optically active monomer like lactic acid, if the optical purity is 80% or less, expressed calculated on the monomer basis, the amount described above is preferable from the viewpoint of solubility to solvents. When the optical purity is more than 80%, expressed calculated on the monomer basis, it is preferable that the amount of the linear polyester resin (b1) relative to the total amount of binder resin satisfy a relationship between a resin (b1) content Y (%) to the total amount of binder resin and X, $Y \leq -1.5X + 220$, from the viewpoint of the dispersibility and solubility to solvents.

The mass ratio of the polyester diol (b11) having a polyhydroxycarboxylic acid skeleton to the polyester diol (b12) other than the polyester diol (b11) each constituting the linear polyester is preferably 31:69 to 90:10, and from the viewpoint of the transparency and thermal properties of the toner particle (C), more preferably 40:60 to 80:20.

The toner of the present invention may contain any conventional resins, in the resin (b), in combination with the liner polyester (b1). The resin for use in combination with the liner polyester (b1) can be suitably selected according the application/purpose. In addition, the resin to be used with the liner polyester (b1) may be a resin (b2) obtainable by reaction of a precursor (b0) in the resin particle forming step. A method of using the precursor (b0) is preferred from the viewpoint of ease of formation of particles. As a reaction method for obtaining the precursor (b0) and obtaining the resin (b2) from the precursor (b0), the following reaction methods can be employed.

Generally, preferred resins to be combined with the liner polyester (b1) are a vinyl resin, a polyester resin, a polyurethane resin, an epoxy resin and combinations thereof. Most preferred are a polyether resin and a polyurethane resin each containing 1,2-propylene glycol as a component unit.

The amount of the resin other than the linear polyester resin (b1) may be suitably adjusted in a preferred range depending on the application, however, from the viewpoint of the transparency and thermal properties of the toner particle (C), it is preferably 0% by mass to 60% by mass, and more preferably 10% by mass to 40% by mass, relative to the amount of the resin (b).

The number average molecular weight (Mn) (measured by Gel Permeation Chromatography, details of the measurement method will be described below), melting point (measured by DSC), glass transition temperature (Tg), sp value (the calculation method of the sp value is described at pp. 147-154, No. 2, Vol. 14 in Polymer Engineering and Science, Feburuary, 1974) of the resin (b) may be suitably adjusted in a preferred range depending on the application.

For example, Mn of the resin (b) is preferably 1,000 to 5,000,000, and more preferably 2,000 to 500,000. The melting point of the resin (b) is preferably 20° C. to 300° C., more preferably 80° C. to 250° C. The Tg of the resin (b) is preferably 20° C. to 200° C., more preferably 40° C. to 200° C. The sp value of the resin (b) is preferably 8 to 16, and more preferably 9 to 14.

The Tg described in the present invention is a value determined from a DSC measurement method or a flow tester measurement method (in the case where it cannot be measured by DSC).

In the DSC measurement, the DSC method specified in ASTM D 3418-82, using a DSC measuring instrument, DSC 20, SSC/580 manufactured by Seiko Instruments Inc.

In the flow tester measurement, an elevated type flow tester, Model CFT 500 manufactured by Shimadzu Corporation, is used. Conditions for the flow tester measurement are as follows. In the present invention, every flow tester measurements are carried out under the following conditions.

(Conditions for Flow Tester Measurement)

Load applied: 30 kg/cm$^2$, Temperature increase rate: 3.0° C./min

Die aperture diameter: 0.50 mm, Die length: 10.0 mm

The polyester resin for use in the first resin (a) has an acid value of 10 mgKOH/g to 40 mgKOH/g, more preferably 10 mgKOH/g to 35 mgKOH/g. When the acid value is more than 40 mgKOH/g, the resulting formed coated film tends to be poor in water resistance. In contast, when it is less than 10 mgKOH/g, a satisfactory aqueous dispersion may not be obtained due to the insufficient amount of carboxyl groups contributing to formation of the aqueous dispersion. Furthermore, it is preferred that the weight average molecular mass measured by GPC (Gel Permeation Chromatography, polystyrene-converted amount) be 9,000 or more or a relative viscosity thereof measured after being dissolved at a concentration of 1 wt %, in a mixed solvent such as phenol/1,1,2,2-tetrachloroethane at a temperature of 20° C. be 1.20 or more. If the weight average molecular weight is less than 9,000 or the relative viscosity is less than 1.20, the coated film formed from the aqueous dispersion of the polyester resin may not have sufficient processability. Further, the weight average molecular weight of the polyester resin is preferably 12,000 or more, and particularly preferably 15,000 or more. The maximum limit of the weight average molecular weight is preferably 45,000 or less. If it is more than 45,000, the operability of production of the polyester resin may be impaired, and an aqueous dispersion using such a polyester resin tends to have an exceedingly high viscosity. The relative viscosity is preferably 1.22 or more and more preferably 1.24 or more. The maximum limit of the relative viscosity is preferably 1.95 or less. If it is more than the value, the operability of production of the polyester resin may be impaired, and an aqueous dispersion using such a polyester resin tends to have an exceedingly high viscosity.

The polyester resin (a) itself is inherently water-indispersible or water-soluble and is virtually synthesized with polybasic acids and/or polyhydric alcohols. The following describes the components of the polyester resin (a).

Among polybasic acids, examples of aromatic dicarboxylic acids include terephthalic acid, isophthalic acid, orthophthalic acid, naphthalene dicarboxylic acid, and biphenyl dicarboxylic acid. In addition, a small amount of 5-sodium sulfoisophthalate and 5-hydroxyisophthalic acid can be used, if required, in a range not impairing the water resistance of the resulting coated film. Examples of aliphatic dicarboxylic acids include unsaturated dicarboxylic acids (oxalic acid, succinic acid, succinic anhydride, adipic acid, azelaic acid, sebacic acid, dodecanedioic acid, hydrogenated dimer acid, etc.), and fumaric acid, maleic acid, maleic anhydride, itaconic acid, itaconic anhydride, citraconic acid, citraconic anhydride, and dimer acid. Examples of alicyclic dicarboxylic acids include 1,4-cyclohexanedicarboxylic acid, 1,3-cyclohexanedicarboxylic acid, 1,2-cyclohexanedicarboxylic acid, 2,5-norbornenedicarboxylic acid (anhydride thereof), and tetrahydrophthlic acid ((anhydride thereof)).

The total amount of the aromatic polybasic acid contained in all acid components of the polyester resin is preferably 50 mol % or more. When the total amount is less than 50 mol %, the skeleton of the resin is occupied by structured derived from aliphatic polybasic acid and alicyclic polybasic acid, and thus the hardness, smear resistance and water resistance of the coated film to be formed tend to degrade. Furthermore, the storage stability of the aqueous dispersion may degrade because the hydrolyzability resistance of the aliphatic and/or alicyclic ester bonds is lower than those of aromatic ester bonds. In order to ensure the storage stability of the aqueous dispersion, the amount of the aromatic polybasic acid contained in the total acid components is preferably 70 mol % or more. In terms of capabilities of improving the processability, water resistance, chemical resistance and weatherability while maintaining other properties of the resulting coated film, it is particularly preferred, to achieve the objects of the present invention, that a terephthalic acid be contained in an amount of 65 mol % or more in the total acid components constituting the polyester resin.

Meanwhile, examples of the polyhydric alcohol components include, as glycols, aliphatic glycols having 2 to 10 carbon atoms, alicyclic glycols having 6 to 12 carbon atoms, and ether bond-containing glycols. Specific examples of the aliphatic glycols having 2 to 10 carbon atoms include ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol, and 2-ethyl-2-butylpropanediol. Examples of the alicyclic glycols having 6 to 12 carbon atoms include 1,4-cyclohexane dimethanol. Examples of the ether bond-containing glycols include diethylene glycol, triethylene glycol, dipropylene glycol, and glycols obtainable by adding one mole to several moles of ethylene oxide or propylene oxide to two phenolic hydroxyl groups of bisphenols (e.g. 2,2-bis(4-hydroxyethoxyphenyl)propane. Polyethylene glycols, polypropylene glycols, and polytetramethylene glycols can also be used if necessary, however, ether structures degrade the water resistance and weatherability of the polyester resin coated film, and thus the use amount thereof is preferably minimized to 10 wt % or less, more preferably 5 wt % or less relative to the total polyhydric alcohol components.

In the present invention, ethylene glycol and/or neopentyl glycol are preferably included in an amount of 50 mol % or more, particularly 65 mol % or more in all the polyhydric alcohol components of the polyester resin. Since large amounts of ethylene glycol and neopentyl glycol are industrially produced, these materials are available at low costs and can maintain various properties in balance. Ethylene glycol components have an advantage of improving especially chemical resistance, and neopentyl glycol components have an advantage of improving especially weatherability.

The polyester resin for use as the resin (a) in the present invention can be copolymerized, if necessary, with a trifunctional or more polybasic acid and/or a trifunctional or more polyhydric alcohol. As the trifunctional or more polybasic acid, trimellitic acid (anhydride), pyromellitic acid (anhydride), benzophenone tetracarboxylic acid (anhydride), trimesic acid, ethylene glycol bis(anhydrotrimellitate), glycerol tris(anhydrotrimellitate), 1,2,3,4-butanetetracarboxylic acid, etc. are used. As the trifunctional or more polyhydric alcohol, glycerin, trimethylethane, trimethylol propane, pentaerythritol, etc are used. The trifunctional or more polybasic acid and/or trifunctional or more polyhydric alcohol are copolymerized in a range of 10 mol % or less and more preferably 5 mol % or less, relative to all the acid components or all the alcohol components. When these components are copolymerized in a range more than 10 mol % or more, high processability of the resulting coated film, which is an advantage of the polyester resin, does not be exhibited.

In addition, aliphatic acids (e.g. lauric acid, myristic acid, palmitic acid, stearic acid, oleic acid, and linoleic acid), ester-formable derivatives thereof, monocarboxylic acids having a high boiling point (e.g. benzoic acid, p-tert-butyl benzoate, cyclohexane acid, and 4-hydroxyphenyl stearate), monoalcohols having a high boiling point (e.g. stearyl alcohol, and 2-phenoxy ethanol), ϵ-caprolactone, lactic acid, hydroxycarboxylic acids (e.g. β-hydroxy lactate, and p-hydroxy benzoate), and ester-formable derivatives thereof can also be used.

The polyester resin can be synthesized using the monomers by a known method. For example, (a) a method in which all monomer components and/or a low-molecular weight polymer thereof is reacted in an inactive atmosphere at a temperature of 180° C. to 250° C. for about 2.5 hours to about 10 hours to perform an esterification reaction, and a polycondensation reaction proceeds in the present of a catalyst at a temperature of 220° C. to 280° C. under reduced pressure of 1 Torr or lower until the viscosity of the reaction product reaches a desired melt viscosity to thereby produce a polyester resin, (b) a method in which the above-noted polycondensation reaction is completed at a stage before the viscosity of the reaction product reaches a desired melt viscosity, and in the subsequent step, the reaction product is mixed with a chain extending agent selected from a polyfunctional epoxy-based compound, isocyanate compound, oxazoline-based compound etc., to be reacted for a short time to make the resulting resin have a high molecular weight, and (c) a method in which the polycondensation reaction proceeds until the viscosity of the reaction product has a desired melt viscosity or higher, monomer components are further added to the reaction product and the reaction product is depolymerized in an inactive atmosphere under normal pressure to a pressurized pressure to thereby obtain a polyester resin having a desired melt viscosity.

The carboxyl groups necessary for the aqueous formation are preferably eccentrically-located at the ends of resin molecular chains, rather than being present in the resin skeleton, in terms of water resistance of a coated film to be formed. The following are preferred embodiments of methods of introducing a specific amount of carboxyl groups to the ends of molecular chains of a high-molecular weight polyester resin, in the case of producing a polyester resin: a method in which a trifunctional or higher functional polybasic acid component is added to the reaction product after the polycondensation reaction is started in the method (a) above, or a polybasic anhydride is added to the reaction product immediately before the polycondensation reaction is completed; a method in which, in the method (b) above, a low-molecular weight polyester resin, in which most of ends of the molecular chains are carboxyl groups, is made to have higher molecular weight using a chain extending agent; and a method in which, in the method (C) above, a polybasic acid component is used as a depolymerizing agent.

The amount of the polyester resin contained in the polyester resin aqueous dispersion is suitably selected depending on the application, dry film thickness, and the forming method. It is, however, preferably used in the range of 0.5 wt % to 50 wt %, and more preferably in the range of 1 wt % to 40 wt %. As described below, the polyester resin aqueous dispersion of the present invention has an advantage in its superiority in storage stability, even when the polyester resin is contained at a high-solid content concentration of 20 wt % or more. However, the polyester resin content is more than 50 wt %, the polyester resin aqueous dispersion has an exceedingly high viscosity and thus it may be difficult to be actually molded.

[Basic Compound]

The polyester resin for use in the resin (a) in the present invention is neutralized with a basic compound when being dispersed in an aqueous medium. In the present invention, the neutralization reaction with carboxyl groups in the polyester resin is an impetus of aqueous formation (forming resin fine particles), and by being combined with a slight amount of the after-mentioned compound exhibiting a protective colloid effect, it is possible to prevent aggregation between fine particles by an electric repulsion force provided from generated carboxy anions. As the basic compound, a compound which is volatilizable at the time of forming a coated film or baking and curing using a curing agent is preferable. Examples of such a compound include ammonia and an organic amine compound having a boiling point of 250° C. or lower. Preferred examples of the organic amine compound include triethyl amine, N,N-diethylethanolamine, N,N-dimethylethanolamine, aminoethanolamine, N-methyl-N,N-diethanolamine, isopropylamine, iminobis-propylamine, ethylamine, diethylamine, 3-ethoxypropylamine, 3-diethylaminopropylamine, sec-butylamine, propylamine, methylaminopropylamine, dimethylaminopropylamine, methyliminobis-propylamine, 3-methoxypropylamine, monoethanolamine, diethanolamine, triethanolamine, morpholine, and N-methylmorpholine, N-ethylmorpholine. The basic compound is preferably added in an amount by which at least a part thereof can be neutralized to the carboxyl groups contained in the polyester resin, i.e. it is preferably added in an equivalent amount of 0.2 times to 1.5 times the amount of the carboxyl groups and more preferably in an equivalent amount of 0.4 times to 1.3 times the amount of the carboxyl groups. When the additive amount of the basic compound is less than 0.2 times the amount of the carboxyl groups, the effect of addition of the basic compound is not recognized, and whereas it is more than 1.5 times, the polyester resin aqueous dispersion may have an exceedingly high viscosity.

[Amphiphilic Organic Solvent]

In the present invention, for the purpose of accelerating the aqueous formation, it is necessary to use, in the aqueous formation, an amphiphilic organic compound having plasticizing capabilities to polyester resins. However, an amphiphilic organic compound having a boiling point higher than 250° C. cannot be satisfactorily removed in drying of the coated film due to its too slow evaporation rate thereof. Therefore, a general-purpose compound called "organic solvent", which has a boiling point of 250° C. or less and have low toxicity, less explosiveness and flammability, is employed.

Properties required for an organic solvent in the present invention are being amphiphilic and having plasticizing capabilities. Here, the amphiphilic organic solvent means an organic solvent which has solubility to water (20°) of 5 g/L or more and more desirably, of 10 g/L or more. An amphiphilic organic solvent having a solubility less than 5 g/L is poor in effect of accelerating the aqueous formation processing speed. In addition the plasticizing capabilities of such an organic solvent can be determined by performing the following simple test. Specifically, a square plate having a size of 3 cm×3 cm×0.5 cm (thickness) is prepared from a polyester resin to be tested. The plate is immersed in 50 mL of an organic solvent and left standing in an atmospheric air of 25° C. to 30° C. Three hours later, if the square plate is obviously deformed in shape, or in the case where when a stainless steel-round bar having a diameter of 0.2 cm is contacted with the square plate while a pressing force of 1 kg/cm$^2$ is statically applied in the thickness direction thereof, the round bar enters into the plate 0.3 cm or more, it is determined that the organic solvent has plasticizing capabilities. An organic solvent judged as having no or less plasticizing capabilities is poor in effect of accelerating the aqueous formation processing speed.

Specific examples of the organic solvent include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-propanol, n-hexanol, and cyclohexanol; ketones such as methylethylketone, methyl isobutyl ketone, ethyl butyl ketone, cyclohexanone, and isophorone; ethers such as tetrahydrofuran, dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate, and dimethyl carbonate; glycol derivatives such as ethylene glycol, ethylene glycol monomethyl ether, ethylene glycol monoethyl ether, ethylene glycol monobutyl ether, ethylene glycol ethyl ether acetate, diethylene glycol, diethylene glycol monomethyl ether, diethylene glycol monoethyl ether, diethylene glycol monobutyl ether, diethylene glycol ethyl ether acetate, propylene glycol, propylene glycol monomethyl ether, propylene glycol monobutyl ether, and propylene glycol methyl ether acetate; 3-methoxy-3-methyl butanol, 3-methoxy butanol, acetonitrile, dimethylformamide, dimethylacetamide, diacetone alcohol, and ethyl acetoacetate. These solvents may be used alone or in combination.

Among the organic solvents exemplified above, it is preferred to singularly use a compound satisfying the following two conditions or to use two or more organic solvents therefrom in the form of a mixture, since not only can an excellent effect of accelerating the aqueous formation processing speed be obtained but also the produced polyester resin aqueous dispersion is superior in storage stability.

(Condition 1) The compound has a hydrophilic structure in which four or more carbon atoms are directly bonded in its molecule.

(Condition 2) The compound has a substituent, at the ends of the molecule, containing one or more atoms having an electronegativity (Pauling) of 3.0 or greater, and has such a polar substituent that the chemical shift of $^{13}$C-NMR (nuclear magnetic resonance) spectrum of the carbon atoms directly bonded to the atoms having an electronegativity of 3.0 or greater, measured at room temperature and in $CDCl_3$, is 50 ppm or higher.

Specific examples of the substituent specified by Condition 2 include alcohols such as alcoholic hydroxyl group, methyl ether group, ketone group, acetyl group, and methyl ester group. Among compounds satisfying Condition 2, especially suitable ones are alcohols such as n-butanol, iso-butanol, sec-butanol, tert-butanol, n-amyl alcohol, isoamyl alcohol, sec-amyl alcohol, tert-amyl alcohol, n-hexanol, and cyclohexanol; ketones such as methylisobutylketone, and cyclohexanone; esters such as n-butyl acetate, isobutyl acetate, sec-butyl acetate, and 3-methoxybutyl acetate; glycol derivatives such as ethylene glycol monobutyl ether, diethylene glycol monobutyl ether, and propylene glycol monobutyl ether; and 3-methoxy-3-methylbutanol, and 3-methoxybutanol.

If the organic solvent has a boiling point of 100° C. or lower or is azeotropic with water, a part of all thereof can be removed from the system (stripping) in the course of aqueous formation or the subsequent process thereof. The organic solvent should be added to the polyester resin aqueous dispersion in an amount of 0.5 wt % to 10 wt %, preferably in an amount of 0.5 wt % to 8.0 wt %, more preferably in an amount of 1.0 wt % to 5.0 wt %. A polyester resin aqueous dispersion containing such an organic solvent in an amount of 0.5 wt % to 10 wt % is superior in storage stability and in coat-film formability. When the amount of the organic solvent is less than 0.5 wt %, it takes long hours to perform aqueous formation, and a polyester resin fine particles having a desired particle size distribution may not be produced. Whereas, when it is more than 10 wt %, not only the purpose of performing the aqueous formation is impaired, but also the viscosity of the aqueous dispersion becomes exceedingly high due to the high existence ratio of secondary particles contained in the aqueous dispersion, and further degradation in storage stability and in coated film formability may occur.

[Compound Having Protective Colloid Effect]]

In the present invention, for the purpose of ensuring the stability of the aqueous dispersion in the process of removing the organic solvent from a reaction system (stripping) or when the aqueous dispersion is stored, a compound having a protective colloid effect is used as necessary. The term "protective colloid effect" described in the present invention means that a compound having a protective colloid effect adsorbs surfaces of resin fine particles in the aqueous dispersion to exert its stabilization effect, called "mixture effect", "osmotic pressure effect" or "volume limiting effect", thereby preventing adsorption of each of resin fine particles. Examples of the compound having protective colloid effect include polymers of vinyl monomer containing, as single component, polyvinyl alcohol, carboxy methyl cellulose, hydroxyethyl cellulose, hydroxypropyl cellulose, modified starch, polyvinyl pyrrolidone, polyacrylic acid, acrylic acid and/or methacrylic acid; polyitaconic acid, gelatin, Arabic rubber, casein, and swellable mica. Such a compound is partially neutralized with a water-soluble or basic compound to become water-soluble. In order to prevent impairment of water resistance of the resulting coated film, the basic compound must be ammonia and/or the above-mentioned organic amine compound. In order to make the protective colloid exhibit its protective colloid effect in a small amount thereof and avoid impairment of the water resistance, and chemical resistance etc., of the coated film to be formed, the number average molecular weight of the compound having protective colloid effect is preferably 1,500 or more, more preferably 2,000 or more, and still more preferably 2,500 or more.

The amount of the compound having protective colloid effect used is 0.01 wt % to 3 wt %, and more preferably 0.03 wt % to 2 wt % relative to the polyester resin. Within this range, it is possible to greatly improve the stability of the polyester resin aqueous dispersion in the aqueous formation process and when the aqueous dispersion is stored, without impairing various properties of a coated film to be formed. In addition, with use of such a compound having a protective colloid, the acid value of the polyester resin and the organic solvent content can be reduced. The amount of the organic solvent used to the polyester resin (A) is 0.05 wt % or less, and preferably 0.03 wt % or less. When the amount is 0.05 wt % or less, it is possible to greatly improve the stability of the polyester resin aqueous dispersion in the aqueous formation process and when the aqueous dispersion is stored, without impairing various properties of a coated film to be formed.

The toner particle (C) for use in the present invention may be obtained by any production methods, provided that the surface of the resin-containing particle (B) containing a second resin (b) is coated with a resin particle (A) containing a first resin (a) or a coated film (P) containing a resin (a).

The toner particle (C) of the present invention may be produced by any methods and any processes. For example, the following describes examples of production methods of resin particles (I), (II), but the methods are not limited thereto.

(I): A method in which an aqueous dispersion (W) of resin particle (A) containing a first resin (a) and [a second resin (b) or an organic solvent solution and/or dispersion liquid thereof] (hereinafter, referred to as "(O1)"), or [a precursor (b0) of the second resin (b) or an organic solvent solution and/or dispersion liquid thereof] (hereinafter, referred to as "(O2)") are mixed, so that (O1) or (O2) is dispersed in (W), to thereby forming, in the aqueous dispersion (W), resin-containing particle (B) containing the second resin (b). In this case, the resin particle (A) or the coating layer (P) are/is secured on surfaces of the resin-containing particle (B) at the same time as the granulation of the resin-containing particle (B) to yield an aqueous dispersion (X) of the toner particle (C), followed by removal of the aqueous medium from the aqueous dispersion (X).

(II): A method in which surfaces of resin-containing particle (B) containing a resin (b), which has been prepared beforehand, are coated with a coating agent (W') containing a first resin (a), thereby producing toner particle (C). In this case, the coating agent may be any form such as liquid and solid; further, the resin-containing particle (B) are coated with a precursor (a') of the first resin (a) so as to react with (a') so as to be secured with the first resin (a). The resin-containing particle (B) used may be resin particles produced by emulsification aggregation method or pulverization method, or any other production method. The coating method is not particularly limited. For instance, the following methods are exemplified: a method of dispersing preliminarily produced resin-containing particle (B) or a dispersion of (B) in an aqueous dispersion liquid (W) of resin particle (A) containing the first resin (a); and a method of spraying the resin-containing particle (B) with a solution liquid of (a) as a coating agent.

Among these methods, the production method (I) is preferably employed.

It is more preferable that the toner particle (C) be obtained by the following production method, in terms that the resulting resin particles will have uniform particle size.

When the aqueous dispersion liquid (W) of the resin particle (A) and (O1) [the second resin (b) or an organic solvent solution and/or dispersion liquid thereof] or (O2) [a precursor (b0) of the second resin (b) or an organic solvent solution and/or dispersion liquid thereof] so that (O1) or (O2) is dispersed in the aqueous dispersion liquid (W), to form resin-containing particle (B) containing the second resin (b), the resin particle (A) are made adsorbed on the surfaces of the resin-containing particle (B), whereby preventing mutual coalescence of the toner particle (C) and making it difficult for the toner particle (C) to split up under application of high shearing force. With this, the particle diameters of the toner particle (C) converge on a constant value, making it possible to enhance the uniformity of their particle diameters. Therefore, the resin particle (A) preferably have, for example, the following physical properties: the particles have a strength so as not to be split up by shearing force applied at temperatures when dispersed; the particles are hardly dissolved and/or swollen in water; and the particles are hardly dissolved in the resin (b) or an organic solvent solution and/or dispersion liquid thereof, or (b0) [a precursor of the resin (b) or an organic solvent solution and/or dispersion liquid thereof]

Meanwhile, the colorant, releasing agent and modified layered inorganic mineral, which are toner components, are incorporated into the resin-containing particle (B). Therefore, before mixing of (W) and (O) (O1 or O2), these toner components are preliminarily dispersed in the solution of (O). The charge controlling agent may be incorporated in the resin-containing particle (B) or externally added thereinto. When the charge controlling agent is incorporated thereinto, it is dispersed in the solution of (O). When the charge controlled agent is externally added thereto, it is externally added after formation of the toner particle (C).

From the perspective of reducing the effect of resin particle (A) being dissolved or swollen in water or a solvent used in dispersion treatment, it is preferable to suitably adjust the molecular weight and a sp value (calculation of sp value, calculated based on the method described in "Polymer Engineering and Science, February", 1974, VoL. 14, No. 2, pp. 147-154), the crystallinity, molecular weight at its crosslinking point etc. of the resin (a).

In the present invention, the number average molecular weight (Mn) and weight average molecular weight (Mw) of resins other then polyurethane resins such as the polyester resin are measured for a tetrahydrofuran (THF) soluble fraction using Gel Permeation Chromatography (GPC) under the following conditions:

Apparatus (e.g.): HLC-8120, manufactured by Tosoh Corporation

Column (e.g.): TSK-GEL GMHXL (two columns)

: TSK-GEL MULTIPORE HXL-M (one column)

Sample solution: 0.25% THF solution

Injected amount of sample solution: 100 μL

Flow rate: 1 mL/min

Measurement temperature: 40° C.

Detection device: refractive index detector

Reference material: standard polystyrene, produced by Tosoh Corporation (TSK Standard POLYSTYRENE) 12 types (molecular weight: 500, 1,050, 2,800, 5,970, 9,100, 18,100, 37,900, 96,400, 190,000, 355,000, 1,090,000, 2,890, 000)

In addition, the Mn and Mw of the polyurethane are measured by GPC under the following conditions:

Apparatus (e.g.): HLC-8220GPC, manufactured by Tosoh Corporation

Column (e.g.): Guard column aTSK-GELa-M

Sample solution: 0.125% dimethyl formaldehyde solution

Injected amount of sample solution: 100 μL

Flow rate: 1 mL/min

Measurement temperature: 40° C.

Detection device: refractive index detector

Reference material: standard polystyrene, produced by Tosoh Corporation (TSK Standard POLYSTYRENE) 12 types (molecular weight: 500, 1,050, 2,800, 5,970, 9,100, 18,100, 37,900, 96,400, 190,000, 355,000, 1,090,000, 2,890, 000)

The glass transition temperature (Tg) of the resin (a), from the perspective of particle size uniformity of toner particle (C), powder flowability, heat resistant-storage stability, and anti-stress property of the toner particle (C), is preferably 50° C. to 100° C., more preferably 51° C. to 90° C., and particularly preferably 52° C. to 75° C. When the Tg is lower than a temperature employed when the aqueous resin dispersion is prepared, the effect of prevnting coalescence and cleavage is reduced, resulting in a reduction of effect of enhancing the particle size uniformity. The Tg of the resin particle (A) containing the resin (a) and Tg of the coating layer (P) containing the resin (a) is, for the same reason, preferably 20° C. to 200° C., more preferably 30° C. to 100° C., and particularly preferably 40° C. to 85° C. Note that in the present invention, Tg is a value determined from the DSC measurement or flow tester measurement (when it is impossible to measure Tg by DSC) as described above.

In the DSC measurement, the glass transition temperature (Tg) is measured by the DSC method specified in ASTM D 3418-82, using a DSC measuring instrument, DSC 20, SSC/580 manufactured by Seiko Instruments Inc. In the flow tester measurement, an elevated type flow tester, Model CFT 500 manufactured by Shimadzu Corporation, is used. Conditions for the flow tester measurement are as follows. In the present invention, every flow tester measurements are carried out under the following conditions.

(Conditions for Flow Tester Measurement)

Load applied: 30 kg/cm$^2$, Temperature increase rate: 3.0° C./min

Die aperture diameter: 0.50 mm, Die length: 10.0 mm

The resin (a) is selected from conventionally known resins as described above. The glass transition temperature (g) of the resin (a) can be easily controlled by changing the molecular weight of the resin (a) and/or the composition of monomers constituting the resin (a). The molecular weight of the resin (a) (the greater the molecular weight of the resin (a) is, the higher the glass transition temperature thereof is) can be controlled by a known method. For example, when a resin like a polyester resin is polymerized by successive reactions, the molecular weight thereof can be controlled by adjusting the charging ratio of monomers.

In the aqueous dispersion liquid (W) of the resin particle (A), among from the after-mentioned organic solvents (u) except for water, an organic solvent miscible with water (acetone, methylethylketone, etc.) may be contained. The type and the amount of the organic solvent to be used on this occasion may be arbitrarily determined, as long as it does not cause aggregation of resin particle (A), does not dissolve resin particle (A) and does not prevent granulation of resin particle (A), preferred is an organic solvent that will not remain in toner particle (C) after dried when it is used with water in an amount of 40% by mass or less.

The organic solvent (u) for use in the present invention may be added into an aqueous medium or an emulsified dispersion [an oil phase (O1) or (O2) containing the resin (b) or (b0)] at the time of emulsification dispersion, as necessary. Specific examples of the organic solvent (u) are aromatic hydrocarbon solvents such as toluene, xylene, ethylbenzene, and tetralin; aliphatic or alicyclic hydrocarbon solvents such as n-hexane, n-heptane, mineral split, and cyclohexane; halogen solvents such as methyl chloride, methyl bromide, methyl iodide, methylene dichloride, carbon tetrachloride, trichloroethylene, and perchloroethylene; ester or ester-ether solvents such as ethyl acetate, butyl acetate, methoxybutyl acetate, methylcellosolve acetate, and ethylcellosolve acetate; ether solvents such as diethylether, tetrahydrofuran, dioxane, ethylcellosolve, butylcellosolve, propylene glycol monomethyl ether; ketone solvents such as acetone, methylethylketone, methylisobutylketone, di-n-butylketone, and cyclohexanone; alcohol solvents such as methanol, ethanol, n-propanol, isopropanol, n-butanol, isobutanol, t-butanol, 2-ethylhexyl alcohol, benzyl alcohol; amide solvents such as dimethylformamide, and dimethylacetoamide; sulfooxide solvents such as diemthylsulfoxide; heterocyclic compound based solvents such as N-methylpyrollidone; and mixture solvents thereof.

The plasticizer (V) may be added into an aqueous medium or an emulsified dispersion [an oil phase (O1) or (O2) containing the resin (b) or (b0)] at the time of emulsification dispersion, as necessary. The plasticizer (V) is not particularly limited, and the following are examples thereof.

(V1) phthalic ester [dibutyl phthalate, dioctyl phthalate, butylbenzyl phthalate, diisodecyl phthalate, etc.];

(V2) aliphatic dibasic ester [di-2-ethylhexyl adipate, 2-ethylhexyl sebacate, etc.];

(V3) trimellitic ester [tri-2-ethylhexyl trimellitate, trioctyl trimellitate, et.];

(V4) phosphoric ester [trimethyl phosphate, tri-2-ethylhexyl phosphate, tricresyl phosphate, etc.];

(V5) fatty acid ester [butyl oleate, etc.]; and (V6) mixtures thereof.

In the present invention, the particle diameter of the resin particle (A) is usually smaller than that of the resin-containing particle (B) to be formed. From the viewpoint of uniformity of particle diameters, a value of the particle diameter ratio [volume average particle diameter of resin particle (A)]/[volume average particle diameter of resin-containing particle (B)] is preferably within the range of 0.001 to 0.3. More preferably, the minimum limit value of the particle diameter ratio is 0.003, and the maximum limit value of the particle diameter ratio is 0.25. When the particle diameter ration is more than 0.3, the resin particle (A) are not efficiently adsorbed on the surfaces of the resin-containing particle (B), and thus the particle size distribution of the resulting toner particle (C) tends to be large.

The volume average particle diameter of the resin particle (A) can be suitably adjusted so as to be suitable for obtaining toner particle (C) having a predetermined particle size. Generally, the volume average particle diameter of the resin particle (A) is preferably in the range of 0.0005 μm to 1 μm. The maximum limit value of the volume average particle diameter is more preferably 0.75 μm, and particularly preferably 0.5 μm. The minimum limit value is more preferably 0.01 μm, particularly preferably 0.02 μm, and most preferably 0.04 μm. Note that if it is desired to obtain toner particle (C) having a volume average particle diameter of 1 μm, the minimum limit value is preferably within the rage of 0.0005 μm to 0.30 μm, and particularly preferably within the range of 0.001 μm to 0.2 μm; and when it is desired to obtain toner particle (C) having a volume average particle diameter of 10 μm, the minimum limit value is preferably within the range of 0.005 μm to 0.8 μm, and particularly preferably within the range of 0.05 μm to 1 μm. The volume average particle diameter can be measured by a laser particle size distribution measurement apparatus LA-920 (manufactured by HORIBA Ltd.), MULTISIZER III (manufactured by Coulter Co.), or ELS-800 (manufactured by Otsuka Electronics Co., Ltd.) which employs a Laser Dopplar Method, or the like. If a difference in measured value of particle size arises between these individual measurement apparatuses, a value measured by LS-800 is employed. Note that the volume average particle diameter of the after-mentioned resin-containing particle (B) is preferably, in terms that the above-mentioned particle diameter ratio is easily obtained, 0.1 μm to 15 μm, more preferably 0.5 μm to 10 μm, and particularly preferably 1 μm to 8 μm.

As the precursor (b0), a combination of a prepolymer (α) having a reactive group with a curing agent (β) can also be used. Note that the term "reactive group" means a group capable of reacting with the curing agent (β). In this case, as a method of forming resin-containing particle (B) containing a resin (b2), which can be obtained by a reaction with the precursor (b0) in the forming process of toner particle (C), the following methods are exemplified: a method in which an oil phase containing a reactive group-containing prepolymer (α), a curing agent (β) and, when necessary, an organic solvent (u), is dispersed in an aqueous dispersion liquid of resin particle (A), and then heated so as to react the reactive group-containing prepolymer (α) with the curing agent (β), thereby forming resin-containing particle (B) containing the resin (b2); a method in which a reactive group-containing prepolymer (α) or a organic solvent solution and/or dispersion liquid thereof is dispersed in an aqueous dispersion liquid of resin particle (A), followed by addition of a water-soluble curing agent (β) so as to be reacted, thereby forming resin-containing particle (B) containing the resin (b2); and a method in which when a reactive group-containing prepolymer (α) is a material reactable with water to be cured, the prepolymer (α) or an organic solvent solution and/or dispersion liquid thereof is dispersed in an aqueous dispersion liquid (W) of resin particle (A) so as to react with each other, thereby forming resin-containing particle (B) containing the resin (b2).

As a combination of a reactive group contained in the reactive group-containing prepolymer (α) with the curing agent (O), the following [1] and [2] are exemplified:

[1] a combination between a reactive group contained in the reactive group-containing prepolymer (α), which is a functional group (α1) capable of reacting with active hydrogen compounds and a curing agent (β) which is an active hydrogen group-containing compound (β2); and

[2] a combination between a reactive group contained in the reactive group-containing prepolymer (α), which is an active hydrogen-containing group (α2) and a curing agent (β) which is a compound (β2) reactable with the active hydrogen-containing group (α2).

Of these combinations, [1] is more preferable in terms of reaction rate in water. In the combination [1], as a functional group (α1) reactable with active hydrogen compound, an isocyanate group (α1a), a blocked isocyanate group (α1b), an epoxy group (α1c), an acid anhydride group (α1d) and an acid hydride group (α1e) are exemplified. Among these, preferred are (α1a), (α1b) and (α1c), and particularly referred are (α1a) and (α1b). The term "blocked isocyanate group (α1b)" means an isocyanate group blocked by a blocking agent. Examples of the blocking agent include oximes [acetoxime, methylisobutylketoxime, diethylketoxime, cyclopentanone oxime, cyclohexanone oxime, methylethylketoxime, etc.]; lactams [γ-butyrolactame, ε-caprolactam, γ-valerolactam, etc.]; aliphatic alcohols having 1 to 20 carbon atoms [ethanol, methanol, octanol, etc.]; phenols [phenol, cresol, xylenol, nonylphenol, etc.]; active methylene compounds [acetylacetone, ethyl malonate, ethyl acetoacetate, etc.]; basic nitrogen-containing compounds [N,N-diethylhydroxylamine, 2-hydroxypyridine, pyridine-N-oxide, 2-mercaptopyridine, etc.]; and mixtures thereof. Among these, preferred are oximes, and particularly preferred are methylethylketoxime.

As a skeleton of the reactive group-containing prepolymer (α), polyether (αw), polyester (αx), epoxy resin (αy) and polyurethane (αz) are exemplified. Among these, preferred are (αx), (αy) and (αz), and particularly preferred are (αx) and (αz). Examples of the polyether (αw) include polyethylene oxide, polypropylene oxide, polybutylene oxide, and polytetramethylene oxide. Examples of the polyester (αx) include polycondensation products between a diol (11) and a dicarboxylic acid (13), and polylactone (ring-opening polymer of ε-caprolactone, etc.). Examples of the epoxy resin (αy) include addition condensation products between bisphenol (bisphenol A, bisphenol F, bisphenol S, etc.) and epichlorohydrin. Examples of the polyurethane (αz) include polyaddition products between a diol (11) and a polyisocyanate (15), and polyaddition products between the polyester (αx) and the polyisocyanate (15).

As a method of introducing a reactive group into the polyester (αx), epoxy resin (αy), polyurethane (αz) or the like, the following methods are exemplified;

[1] a method in which one of two or more components is excessively used in amount to make its functional group of the component present at the ends of the skeleton; and

[2] a method in which one of two or more components is excessively used in amount to make its functional group of the components reside at the ends of the skeleton, and further, a compound containing a functional group capable of reacting with the remaining functional group and a reactive group is added so as to react with each other.

In the method [1] described above, it is possible to obtain a hydroxyl group-containing polyester prepolymer, a carboxyl group-containing polyester prepolymer, an acid halide group-containing polyester prepolymer, a hydroxyl group-containing epoxy resin prepolymer, an epoxy group-containing epoxy resin prepolymer, a hydroxyl group-containing polyurethane prepolymer, an isocyanate group-containing polyurethane prepolymer, etc. As for the ratio of constitutional components, for example, in the case of a hydroxyl group-containing polyester prepolymer, the mixing ratio of the polyol (1) to the polycarboxylic acid (2), as an equivalent ratio [OH]/[COOH] of hydroxyl group [OH] content relative to carboxyl group [COOH] content in the polyester resin, is preferably 2/1 to 1/1, more preferably 1.5/1 to 1/1, and particularly preferably 1.3/1 to 1.02/1. In the case of a prepolymer having a different skeleton and different end groups therefrom, the same applies to the mixing ratio, with only a change in their components.

In the method [2] described above, to a prepolymer obtained by the method [1], a polyisocyanate is reacted to thereby an isocyanate group-containing prepolymer can be obtained; a blocked polyisocyanate is reacted to thereby obtain a blocked isocyanate group-containing prepolymer; a polyepoxide is reacted to thereby obtain an epoxy group-containing prepolymer; and a polyacid anhydride is reacted to thereby obtain an acid anhydride group-containing prepolymer. As for the amount of a compound containing a functional group and a reactive group used, for example, when a polyisocyanate is reacted to a hydroxyl group-containing polyester to obtain an isocyanate group-containing polyester prepolymer, the mixing ratio of the polyisocyanate, as an equivalent ratio [NCO]/[OH] of isocyanate group [NCO] content in the polyisocyanate to hydroxyl group [OH] content in the hydroxyl group-containing polyester prepolymer, is preferably 5/1 to 1/1, more preferably 4/1 to 1.2/1, and particularly preferably 2.5/1 to 1.5/1. In the case of a prepolymer having a different skeleton and different end groups therefrom, the same applies to the mixing ratio, with only a change in their components.

The number of reactive groups per one molecule in the reactive group-containing prepolymer (α) is usually one or more, preferably L5 to 3 on average, and more preferably 1.8 to 2.5 on average. Within the above range, the molecular weight of a cured product to be obtained by reacting with the curing agent (β) becomes higher. The Mn of the reactive group-containing prepolymer (α) is preferably 500 to 30,000, more preferably 1,000 to 20,000, and particularly preferably 2,000 to 10,000. The weight average molecular weight of the reactive group-containing prepolymer (α) is preferably 1,000 to 50,000, more preferably 2,000 to 40,000, and still more preferably 4,000 to 20,000. The viscosity of the reactive group-containing prepolymer (α) is preferably 2,000 poises or less, and more preferably 1,000 poises or less at 100° C. By setting the viscosity to 2,000 poises or less, it is preferable in that toner particle (C) having a sharp particle size distribution is obtained with a small amount of an organic solvent.

Examples of the active hydroxyl group-containing compound (β1) include polyamine (β1a) which may be blocked with a compound capable of desorbing it, polyol (β1b), polymarcaptane (β1c), and water (β1d). Among these, preferred are (β1a), (β1b) and (β1d), more preferred are (β1a) and (β1d), and more preferred are blocked polyamines and (β1d). As the polyamine (β1a), the same as those described in the polyamine (16) are exemplified. Preferred example of the polyamine (β1a) are 4,4'-diaminodiphenylmethane, xylylenediamine, isophorondiamine, ethylenediamine, diethylenetriamine, triethylenetetramine, and mixtures thereof.

As an example of the case where (β1a) is a polyamine which is blocked with a desorbable compound, the following compounds are exemplified: ketimine compounds obtainable from the polyamines and ketones having 3 to 8 carbon atoms (acetone, methylethylketone, methylisobutylketone, etc.); aldimine compounds, obtainable from aldehyde compounds (formaldehyde, and acetaldehyde) having 2 to 8 carbon atoms, enamine compounds, and oxazolidine compounds.

As the polyol (β1b), the same as those described in the diol (11) and polyol (12) are exemplified. A single use of the diol (11) or a combination with a small amount of the polyol (12) is preferable. As the polymercaptane (β1c), ethylenediol, 1,4-butanediol, 1,6-hexanediol are exemplified.

A reaction stopper (βs) may be used along with the active hydroxyl group-containing compound (β1) as necessary. The additional use of the reaction stopper (βs) at a given ratio makes it possible to adjust the molecular weight of the resin (b2) to a predetermined value. Examples of the reaction stopper (βs) include monoamines (diethylamine, dibutylamine, butylamine, laurylamine, monoethanolamine, diethanolamine, etc.); blocked monoamines (ketimine compounds, etc.); monools (methanol, ethanol, isopropanol, butanol, phenol, etc.); monomercaptanes (butyl mercaptane, lauryl mercaptane, etc.); monoisocyanates (lauryl isocyanate, phenyl isocyanate, etc.); and monoepoxides (butyl glycidyl ether, etc.).

Examples of the active hydrogen-containing group (α2) contained in the reactive group-containing prepolymer (α) in the above-mentioned combination [2] are an amino group (α2a), a hydroxyl group (alcoholic hydroxyl group, and phenolic hydroxyl group) (α2b), a mercapto group (α2c), a carboxyl group (α2d), and an organic group (α2e) which is blocked with a compound capable of desorbing these amino group. Among these, preferred are (α2a), (α2b) and an organic group (α2e) which is blocked with a compound capable of desorbing amino groups; and a hydroxyl group (α2b) is particularly preferable. As the organic group which is blocked with a compound capable of desorbing amino groups, the same as those described in (pa) are exemplified.

Examples of the compound (β2) reactable with an active hydrogen-containing group include a polyisocyanate (β2a), a polyepoxide (β2b), a polycarboxylic acid (β2c), a polycarboxylic anhydride (β2d), and a polyacid hallide (β2e). Among these, preferred are (β2a) and (β2b); and a polyisocyanate (β2a) is more preferred.

As the polyisocyanate (β2a), the same as those described in the polyisocyanate (15) are exemplified, and preferred polyisocyanates are also the same. As the polyepoxide (β2b), the same as those described in the polyepoxide (19) are exemplified, and preferred ones are also the same.

As the polycarboxylic acid (β2c), dicarboxylic acid (β2c-1), and trivalent or higher polyvalent polycarboxylic acid (β2c-2) are exemplified. Examples of the polycarboxylic acid (β2c) include a dicarboxylic acid (β2c-1) and a trivalent or higher polyvalent polycarboxylic acid (β2c-2) are exemplified. A single use of the dicarboxylic acid (β2c-1), and mixtures of a dicarboxylic acid (β2c-1) with a smaller amount of the trivalent or higher polyvalent polycarboxylic acid (β2c-2) are preferable. As the dicarboxylic acid (β2c-1), the same as those described in the dicarboxylic acid (13) are exemplified, and preferred ones are also the same. As the polycarboxylic acid, the same as those described in the polycarboxylic acid (5) are exemplified, and preferred ones are also the same.

As the polycarboxylic anhydride (β2d), pyromellitic anhydrides are exemplified. As the polyacid halides (β2e), the halides of the polycarboxylic acid (β2c) (acid chlorides, acid bromides, and acid iodides, etc.) are exemplified. Further, the reaction stopper (βs) may be used along with the polycarboxylic anhydride (β2d) as necessary.

The mixing ratio of the curing agent (β), as an equivalent ratio [α]/[β] of reactive group [α] content in the reactive group-containing prepolymer (α) to hydroxyl group [β] content in the curing agent (β), is preferably 1/2 to 2/1, more preferably 1.5/1 to 1/1.5, and particularly preferably 1.2/1 to 1/1.2. When the curing agent (β) is water (β1d), it is regarded as a divalent active hydrogen compound.

The resin (b2) obtained by reacting the reactive group-containing prepolymer (α) with the precursor (b0) containing the curing agent (β) becomes a component of the resin-containing particle (B) and the toner particle (C). The weight average molecular weight of the resin (b2) obtained by reacting the reactive group-containing prepolymer (α) with the curing agent (β) is preferably 3,000 or more, still more preferably 3,000 to 10,000,000, and particularly preferably 5,000 to 1,000,000.

In the reaction of the reactive group-containing prepolymer (α) and the curding agent (β) in an aqueous medium, by adding a reactive group-containing prepolymer (α) such as a leaner polyester resin (b1) and a polymer unreactive with the curing agent (β), a so-called "dead polymer" into the reaction system, the resin (b) becomes a mixture of a resin (b2) obtained by the reaction of the reactive group-containing prepolymer (α) with the curing agent (β) in the aqueous medium, and an unreacted resin such as the linear polyester resin (b1).

The amount of the aqueous dispersion (W) used to 100 parts by mass of the resin (b) is preferably 50 parts by mass to 2,000 parts by mass, and more preferably 100 parts by mass to 1,000 parts by mass. When the amount is 50 parts by mass, the dispersed state of the resin (b) is improved, and when the amount is less than 2,000 parts by mass, it is favorable in terms of cost efficiency.

The toner particle (C) can be obtained in the following steps. An aqueous dispersion liquid (W) of resin particle (A) containing a resin (a) is mixed with a resin (b) or an organic solvent solution and/or dispersion liquid (O1) of the resin (b), or a precursor (b0) of the resin (b) or an aqueous solvent solution and/or dispersion liquid (O2) of the precursor (b0), and the solution and/or dispersion liquid (O1) or (O2) is dispersed in the aqueous dispersion (W). When the precursor (b0) is employed, the precursor (b0) is reacted to form a resin (b2) and to obtain an aqueous dispersion (X) of toner particle (C) having a structure where the resin (a) is attached on the surfaces of the resin-containing particle (B) containing the resin (b), followed by removing the aqueous medium from the aqueous resin dispersion (X). The resin (a) attached on the surfaces of the resin-containing particle (B) may take a form of particle (A) or a coating layer (P). Whether the resin (a) becomes the particle (A) or the coating layer (P) is determined depending on the Tg of the resin (a) and the conditions for producing toner particle (C) (including solvent removing temperature).

The shape of particles and their surfaces of the toner particle (C) obtained in the production method (I) can be controlled by controlling the difference in sp value between the resin (a) and the resin (b), and the molecular weight of the resin (a). When the difference in sp value therebetween is small, smooth surfaced particles with indefinite shapes are easily obtained. When the difference is large, rough surfaced particles in spherical shape are easily obtained. When the molecular weight of the resin (a) is large, rough surfaced particles are easily obtained. In contrast, when the molecular weight is small, smooth surfaced particles are easily obtained. Note that if the difference in sp value between (a) and (b) is excessively low or excessively high, it becomes difficult to perform granulation. In view of this, the difference in sp value between (a) and (b) is preferably 0.01 to 5.0, more preferably 0.1 to 3.0, and still more preferably 0.2 to 2.0.

In the case of the production method (II), the shape of the toner particle (C) is greatly affected by the shape of the resin-containing particle (B) which have been produced beforehand, and the toner particle (C) will have a substantially similar shape to that of the resin-containing particle (B). Note that when the resin-containing particle (B) have an indefinite shape and a large amount of a coating agent (W') is used in the production method (II), the resulting toner particle (C) will be spherical in shape.

In the present invention, from the viewpoint of the uniformity of particle diameters and the storage stability of the toner particle (C), the toner particle (C) be preferably composed of a resin particle (A) containing 0.01% by mass to 60% by mass of a resin (a) or a coating layer (P) containing the resin (a) within the same range, and resin-containing particle (B) containing 40% by mass to 99.99% by mass of a resin (b); more preferably composed of resin a particle (A) containing 0.1% by mass to 50% by mass of a resin (a) or a coating layer (P) containing the resin (a) within the same range, and resin-containing particle (B) containing 50% by mass to 99.99% by mass of a resin (b); and particularly preferably composed of a resin particle (A) containing 1% by mass to 45% by mass of a resin (a) or a coating layer (P) containing the resin (a) within the same range, and resin-containing particle (B) containing 55% by mass to 99% by mass of a resin (b). When the amount of the resin particle (A) or the coating layer (P) is 0.01% by mass or more, the blocking resistance of the resulting toner becomes excellent, and when it is 60% by mass or less, the fixability, in particular, the low-temperature fixability becomes excellent.

In the toner particle (C), from the viewpoint of the uniformity of particle diameters, the powder flowability and the storage stability of the toner particle (C), 5% or more, preferably 30% or more, still more preferably 50% or more, particularly preferably 80% or more of the surface area of the resin-containing particle (B) be coated with resin particle (A) containing the resin (a) or the coating layer (P) containing the resin (a). The surface coverage rate of the toner particle (C) can be determined by analysis of images obtained by a scanning electron microscope (SEM), based on the following equation.

Surface coverage rate (%)=[area of portions of resin-containing particle (*B*) coated with (*A*) or (*P*)/area of portions of resin-containing particle (*B*) coated with (*A*) or (*P*)+area of exposed portions of resin-containing particle (*B*)]×100

From the viewpoint of the uniformity of particle diameters, the coefficient of variation in volume distribution of the toner particle (C) is preferably 30% or less, and more preferably 0.1% to 15%. Also, from the viewpoint of the uniformity of particle diameters, a value of [volume average particle diameter/number average particle diameter] of the toner particle (C) is preferably 1.0 to 1.4, and still more preferably 1.0 to 1.3. Although, the volume average particle diameter of the toner particle (C) varies depending on the application, in general, it is preferably 0.1 μm to 16 μm. The maximum limit of the volume average particle diameter is still more preferably 11 μm, and particularly preferably 9 μm. The minimum limit is still more preferably 0.5 μm, and particularly preferably 1 μm. Note that the volume average particle diameter and the number average particle diameter can be measured by a MULTISIZER III (manufactured by Coulter Co.) at a time.

In the present invention, it is possible to provide desired concavo-convexes or irregularities to surfaces of the toner particle (C) by changing the particle diameters of the resin particle (A) and resin-containing particle (B) and by changing the surface coverage rate of the resin-containing particle (B) coated with the coating layer (P) containing the resin (a). If it is desirable to improve the powder flowability, the specific surface area measured by BET method of the toner particle (C) is preferably 0.5 $m^2/g$ to 5.0 $m^2/g$. In the present invention, a value of BET specific surface area is measured by a specific surface area meter, for example, QUANTASORB (manufactured by Yuasa Ionics Inc.) (measurement gas: He/Kr=99.9/0.1 voL %, calibration gas: nitrogen). Also, from the viewpoint of the powder flowability, the average-center line surface roughness (Ra) of the resin particles is preferably 0.01 μm to 0.8 μm. The average-center line surface roughness (Ra) is a value determined by averaging out an absolute deviation between the roughness curve and the center line and can be measured, for example, by a scanning probe microscope system (manufactured by Toyo Technica).

The toner particle (C) is preferably spherically shaped from the viewpoint of the powder flow ability, the melt-leveling and the like. In this case, the resin-containing particle (B) is also preferably spherically shaped. The average circularity of the toner particle (C) is preferably 0.95 to 1.00, more preferably 0.96 to 1.0, and particularly preferably 0.97 to 1.0. Note that the average circularity is a value determined by the following manner: Firstly, particles are optically detected to obtain an image thereof, and the circumferential length of the projected area of the image is divided by the circumferential length of a circle having an area corresponding to the projected area. Specifically, the average circularity is measured by a flow-type particle image analyzer (FPIA-2000, manufactured by Sysmex Corporation). More specifically, 100 mL to 150 mL of water with solid impurities has been removed beforehand is put in a given vessel, 0.1 mL to 0.5 mL of a surfactant (DRYWEL, produced by FUJI FILM Corporation) is added as a dispersant, and about 0.1 g to about 9.5 g of a measurement sample is further added to thereby obtain a suspension liquid with the sample being dispersed therein. The suspension liquid is then subjected to a dispersion treatment in a supersonic dispersing machine (ULTRASONIC CLEANER MODEL VS-150, manufactured by Welvocria Co.) for about 1 minute to about 3 minutes so that the concentration of the dispersion becomes 3,000/μL to 10,000/μL, followed by measurement of the shape and particle distribution of the resin particles.

(Charge Controlling Agent: CCA)

The toner of the present invention can include a charge controlling agent as necessary.

As the charge controlling agent (CCA), azine-based dyes containing an alkyl group having 2 to 16 carbon atoms (Japanese Patent Application Publication (JP-B) No. 42-1627), and basic dyes are exemplified. Specific examples thereof include C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000) and lake pigments of these basic dyes; C.I. Solvent Black 8 (C.I. 26150), quaternary ammonium salts such as benzoyl methyl hexadecyl ammonium chloride and decyl trimethyl chloride, or dialkyl tin compounds such as dibutyl or dioctyl tin compounds, dialkyl tin borate compounds, guanidine derivatives; polyamine resins such as amino group-containing vinyl polymers, and amino group-containing condensation polymers; metal complex salts of monoazo dyes described in Japanese Patent Publication Nos. 41-20153, 43-27596, 44-6397, and 45-26478, metal complexes such as Zn, Al, Co, Cr and Fe complexes of salicylic acid, dialkyl salicylic acid, nap hthoic acid and dicarboxylic acid described in Japanese Patent Publication Nos. 55-42752 and 59-7385; sulfonated copper phthalocyanine pigments; organic boron salts, fluorine-containing quaternary ammonium salts, and calixarene-based compounds. As for color toners other than black toners, charge controlling agents which impede obtaining intended toner color should not be used, and metal salts of salicylic acid derivative in white color are suitably used.

The amount of the charge controlling agent is preferably 0.01 parts by mass to 2 parts by mass, and more preferably 0.02 parts by mass to 1 part by mass per 100 parts by mass of the binder resin. When the amount of the charge controlling agent is 0.01 or more, the resulting toner can have charge controllability. When the amount is 2 parts by mass or less, it is possible to prevent impairment of the effect of the primary charge controlling agent due to excessively high chargeability of the toner and to avoid degradation in flowability of the developer and degradation in image density caused by an increased electrostatic attraction force to developing rollers.

The toner composition of the toner of the present invention preferably contains a layered inorganic mineral in which a portion of interlayer ions is modified with organic ions. The modified layered inorganic mineral used in the present invention is preferably mineral having smectite-based basic crystal structure modified with organic cations. It is also possible to introduce metal anions into the layered inorganic mineral by substituting a part of divalent metal in the layered inorganic mineral with trivalent metal. However, when metal anions are introduced thereinto, the resulting mineral becomes highly hydrophilic. Therefore, a layered inorganic compound in which at least a part of metal anions is modified with organic anions is preferred.

As an organic cation modifier used for the layered inorganic mineral in which interlayer ions are partially modified with inorganic ions, quaternary alkyl ammonium salts, phosphonium salts and imidazole salts are exemplified. Among these, preferred are quaternary alkyl ammonium salts. Specific examples of the quaternary alkyl ammonium salts, trimethyl stearyl ammonium, dimethyl stearyl benzyl ammonium, and oleylbis(2-hydroxyethyl)methyl ammonium.

Specific examples of the organic anion modifier include sulfates, sulfonates, carboxylates or phosphates each further having a branched, unbranched or cyclic alkyl (C1-C44), alkenyl (C1-C22), alkoxy (C8-C32), hydroxyalkyl (C2-C22), ethylene oxide, propylene oxide, and the like. Carboxylic acids having an ethylene oxide skeleton are preferable.

By partially modifying interlayer ions of the layered inorganic mineral with organic ions, it is possible to moderately impart hydrophobicity to the resulting toner. In addition, the toner will have moderate hydrophobicity, the oil phase (O1) containing the toner composition and/or the oil phase (O2) containing toner composition precursor will have a non-Newtonian viscosity, and the resulting toner can be made to have an indefinite shape. At that occasion, the amount of the layered inorganic mineral in which a part of the toner material is modified with the organic ions is preferably 0.05% by mass to 10% by mass, and more preferably 0.05% by mass to 5% by mass.

The layered inorganic mineral in which a part thereof is modified with organic ions may be suitably selected. Examples thereof include montmorillonite, bentonite, hectorite, attapulgite, sepiolite, and mixtures thereof. Among these, organically modified montmorillonite or bentonite is preferable in terms that they do not influence on toner properties, their viscosities can be easily adjusted, and they are effective in a small additive amount.

Specific examples of commercially available layered inorganic mineral in which a part thereof is modified with organic ions include quaternium-18 bentonite such as BENTONE 3, BENTONE 38 and BENTONE 38V (produced by Rheox); TIXOGEL VP (produced by United Catalyst Inc.); CLAYTON 34, CLAYTON 40, and CLAYTON XL (produced by CLAYTON APA Southern Clay Product, Inc.); and stearalkonium bentonite such as BENTONE 27 (produced by Rheox), TIXOGEL LG (produced by United Catalyst Inc.), and CLAYTON AF and CLAYTON APA (produced by CLAYTON APA Southern Clay Product, Inc.); and quaternium-18 benzalkonium bentonite such as CLAYTON HT and CLAYTON PS (produced by Southern Clay Products, Inc.). Particularly preferred are CLAYTON AF and CLAYTON APA. Further, as a layered inorganic mineral in which a part thereof is modified with organic anions, layered inorganic minerals obtained by modification of DHT-4A (Kyowa Chemical Industry Co., Ltd.) with an organic anion represented by the following General Formula (I) are particularly preferable. As a compound represented by the following General Formula (I), for example, HITENOL 330T (produced by DAI-ICHI KOGYO SEIYAKU CO., LTD.) is exemplified.

$$R^1(OR^2)nOSO_3M \qquad \text{General Formula (I)}$$

[In General Formula (1), $R^1$ represents an alkyl group having 13 carbon atoms; $R^2$ represents an alkylene group having 2 to 6 carbon atoms; n is an integer of 2 to 10; and M represents a monovalent metal element.

(Colorant)

As colorants for use in the present invention, known pigments and dyes capable of obtaining yellow, magenta, cyan and black color toners can be used.

Specific examples of yellow pigments include cadmium yellow, mineral fast yellow, nickel titanium yellow, navels yellow, naphthol yellow S, Hansa Yellow G, Hansa yellow 10G, Benzidine Yellow GR, Quinoline Yellow Lake, Permanent Yellow NCG and Tartrazine Yellow Lake.

Specific examples of orange pigments include molybdenum orange, Permanent Orange GTR, Pyrazolone Orange, Vulcan Orange, Indanthrene Brilliant Orange RK, Benzidine Orange G and Indanthrene Brilliant Orange GK.

Specific examples of red pigments include red iron oxide, cadmium red, Permanent Red 4R, Lithol Red, Pyrazolone Red, calcium salt of Watchung Red, Lake Red D, Brilliant Carmine 6B, Eosine lake, Rhodamine Lake B, Alizarine Lake and Brilliant Carmine 3B.

Specific examples of purple pigments include Fast Violet B and Methyl Violet Lake.

Specific examples of blue pigments include cobalt blue, Alkali Blue, Victoria Blue Lake, Phthalocyanine Blue, metal-free Phthalocyanine Blue, partially-chlorinated Phthalocyanine Blue, Fast Sky Blue and Indanthrene Blue BC.

Specific examples of green pigments include Chrome Green, chromium oxide, Pigment Green B and Malachite Green Lake.

Specific examples of black pigments include carbon black, oil furnace black, channel black, lamp black, acetylene black, azine type dyes such as aniline black; metal-containing azo dyes, metal oxides and complex metal oxides.

These colorants may be used alone or in combination.

The amount of colorants contained in the toner is preferably 1% by mass to 15% by mass, and more preferably 3% by mass to 10% by mass. When the amount of colorants is less than 1% by mass, the tinting power of the toner may degrade, whereas, when the amount is more than 15% by mass, a pigment-dispersion defect occurs in the toner, which may cause degradation of the tinting power and degradation of electric properties of the toner.

The colorant may also be used as a masterbatch obtained by combining with a resin. Examples of such a resin include polyester, styrene or polymers of substitution product thereof, styrene copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic resin, rosin, modified rosin, terpene resin, aliphatic hydrocarbon resin, alicyclic hydrocarbon resin, aromatic resin, chlorinated paraffin, and paraffin wax. These resins may be used alone or in combination. Among these resins, particularly preferred are styrene or polymers of substitution product thereof.

Examples of the styrene or polymers of substitution product thereof include polystyrene, poly(p-chlorostyrene), and polyvinyltoluene. Examples of the styrene copolymers include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer.

The masterbatch can be obtained by mixing and kneading the resin for masterbatch and the colorant under application of high shear force. On that occasion, it is preferable to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

(Releasing Agent)

As releasing agents for use in the toner of the present invention, any known releasing agents can be used. Particularly, de-free fatty acid type carnauba wax, polystyrene wax, montan wax and oxidized rice wax can be used singularly or in combination. As the carnauba wax, preferred is a wax which is formed of microscopic crystalline particles, has an acid value of 5 or less and a particle diameter, when dispersed in the toner binder, of 1 μm or smaller. As the montan wax, it is, generally, a montan-based wax which is refined with minerals, and preferred is a wax formed of microscopic crystalline particles similarly to the carnauba wax, and having an acid value of 5 to 14. The oxidized rice wax is obtained by oxidizing rice bran wax in the air and preferably has an acid value of 10 to 30. The reason of use of these waxes is that they can be moderately finely dispersed in the toner binder resin of the present invention, thereby making it possible to readily obtain a toner which is superior in offset resistance, transferability and durability, as described below. These waxes may be used alone or in combination.

As releasing agents other than described above, any conventionally known releasing agents, such as solid silicone wax, higher fatty acid alcohol, montan ester wax, polyethylene wax and polypropylene wax, can be used in the form of a mixture.

The Tg of the releasing agent(s) for use in the toner of the present invention is preferably 70° C. to 90° C. When the Tg is lower than 70° C., the heat-resistant storage stability of the resulting toner degrades, and when it is higher than 90° C., the releasability cannot be sufficiently exhibited in low temperature conditions, causing degradation of anti-cold offset property and paper-winding to a fixing device. The amount of these releasing agents used relative to the toner resin components is preferably 1% by mass to 20% by mass, and more preferably 3% by mass to 10% by mass. When the amount is less than 1% by mass, the effect of offset resistance of the resulting toner is insufficient, and when it is more than 20% by mass, the transferability and durability of the resulting toner degrade.

(Developer)

The developer contains at least the toner of the present invention and further contains other suitably selected components, such as carrier. The developer may be a one-component developer or two-component developer, however, when used in high-speed printers responding to recent enhancement in information processing speed, the two-component developer is preferable in terms of improvement of shelf-life.

(Carrier)

The carrier is not particularly limited and may be suitably selected in accordance with the intended use. Preferred is a carrier including a core material and a resin layer for coating the core material.

The core material is not particularly limited and may be suitably selected from among conventionally known core materials. For example, manganese-strontium (Mn—Sr)-based materials and manganese-magnesium (Mn—Mg) based materials of 50 emu/g to 90 emu/g are preferable. In terms of securing high image density, high magnetization materials such as iron powder (100 emu/g or higher) and magnetite (75 emu/g to 120 emu/g) are preferable. In terms of being capable of easing up the contact pressure to a latent electrostatic image bearing member on which surface a toner stands like a brush and of the advantage in obtaining high-quality image, weak magnetization materials such as copper-zinc (Cu—Zn)-based materials (30 emu/g to 80 emu/g) are preferable. These may be used alone or in combination.

As for the particle diameter of the core material, the average particle diameter (weight average particle diameter (D50)) is preferably 10 μm to 200 μm, and more preferably 40 μm to 100 μm. When the average particle diameter (weight average particle diameter (D50) is smaller than 10 μm, the amount of fine powder particles is increased in a particle size distribution of carrier particles, and the magnetization per particle decreases, possibly causing carrier scattering. When the average particle diameter is greater than 200 μm, the specific area of the toner is reduced, possibly causing toner scattering; in the case of full-color having a large solid part area, the reproducibility, in particular, of solid parts may degrade.

The material of the resin layer is not particularly limited and may be suitably selected from among conventionally known resins. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers between vinylidene fluoride and acrylic monomer, copolymers between vinylidene fluoride and acrylic monomer, copolymers between vinylidene fluoride and vinyl fluoride; fluoroterpolymers (trifluoride (multiple fluoride) copolymers) such as terpolymer of tetrafluoroethylene, vinylidene fluoride and non-fluoro monomer; and silicone resins. These resins may be used alone or in combination. Among these, silicone resins are particularly preferable.

The silicone resin is not particularly limited and may be suitably selected from among generally known silicone resins in accordance with the intended use. Examples of the silicone resin include straight silicone resins made from only organosiloxane bond; and silicone resins modified with an alkyd resin, polyester resin, epoxy resin, acrylic resin, urethane resin or the like.

As the silicone resin, commercially available silicone resins may be used. As straight silicone resins, KR271, KR255, and KR152 produced by Shin-Etsu Chemical Co., Ltd.; and SR2400, SR2406, SR2410 produced by TORAY Dow Corning Silicone Co., Ltd. are exemplified.

As the modified silicone resins, commercially available products may be used. For example, KR206 (alkyd-modified), KR5208 (acryl-modified), ES1001N (epoxy-modified), and KR305 (urethane-modified) produced by Shin-Etsu Chemical Co., Ltd.; and SR2115 (epoxy-modified), and SR2110 (alkyd-modified) produced by TORAY Dow Corning Silicone Co., Ltd. are exemplified.

Note that silicone resin may be used alone, and a crosslinkable component, and a charge amount controlling component may be used together with the silicone resin(s).

As necessary, the resin layer may contain conductive powder or the like. Examples of the conductive powder include iron powder, carbon black, titanium oxide powder, tin oxide powder, and zinc oxide powder. The average particle diameter of these conductive powders is preferably 1 μm or less. When the average particle diameter is greater than 1 μm, it may be difficult to control the electric resistance.

The resin layer can be formed, for example, by the following manner. The silicone resin or the like is dissolved in an organic solvent to prepare a coating solution, the coating solution is applied uniformly on the surface of the core material by a conventionally known coating method, then dried and baked, thereby forming a resin layer. Examples of the coating method include dip-coating methods, spray-coating methods, and brush-coating methods.

The organic solvent is not particularly limited and may be suitably selected in accordance with the intended use. Examples thereof include toluene, xylylene, methylethylketone, methylisobutylketone, Cellosolve, and butyl acetate.

The baking is not particularly limited and may be external heating or internal heating. Examples thereof include methods using fixed electric furnace, fluid electric furnace, rotary electric furnace, burner furnace and methods using a microwave.

The amount of the resin layers in the carrier is preferably 0.01% by mass to 5.0% by mass. When the amount is less than 0.01% by mass, the resin layer may not be formed uniformly on the surface of the core material, and when the amount is more than 5.0% by mass, the resin layer becomes too thick and granulation between carriers occur and uniform carrier particles may not be obtained.

If the developer is a two-component developer, the carrier content in the two-component developer is not particularly limited and may be selected in accordance with the intended use, and with regard to the mixing ratio between toner and carrier of the two-component developer, a toner is generally used in an amount of 1 part by mass to 10.0 parts by mass per 100 parts by mass of carrier.

(Image Forming Apparatus)

The following describes the outline of an image forming apparatus using the toner of the present invention.

The image forming apparatus of the present invention includes at least a latent electrostatic image bearing member (photoconductor), a charging unit configured to charge a surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium. The toner of the present invention is used therein.

A copier as one example of an electrophotographic image forming apparatus of the present invention is illustrated in FIG. 1.

FIG. 1 illustrates one example of an internal configuration diagram of a color image forming apparatus according to one embodiment of the present invention.

This specific example is a tandem type indirect-transfer type electrophotographic copier, however, the image forming apparatus of the present invention is not limited thereto.

Numeral 100 is a main body of a copier, 200 is a paper feeding table on which the copier main body 100 is placed, 300 is a scanner mounted on the copier main body 100 and 400 is an automatic document feeder (ADF) mounted on the scanner 300. The copier main body 100 includes an intermediate transfer member 10 which has the shape of an endless belt and is extendable in a lateral direction. As shown in FIG. 1, the intermediate transfer member 10 is suspended by three support rollers 14, 15 and 16 and rotatable in a clockwise direction. On the left of the secondary support roller 15 of these three support rollers, an intermediate transfer member cleaner 17 is located to remove a residual toner on an intermediate transfer member 10 after an image is transferred. Above the intermediate transfer member 10 which is spanned over the first support roller 14 and the second support roller 15, four image forming units 18 for yellow, cyan, magenta and black colors are located in line from left to right along a transport direction of the intermediate transfer member 10 to form a tandem image forming section 20. Above the tandem image forming section 20, an image exposer 21 is located as shown in FIG. 1. On the opposite side of the tandem image forming section 20 across the intermediate transfer member 10, a secondary transferer 22 is located. The secondary transferer 22 includes a an endless secondary transfer belt 24 and two rollers 23 suspending the endless secondary transfer belt 24, and is pressed against the third support roller 16 across the intermediate transfer member 10 and transfers an image formed on the intermediate transfer member 10 onto a sheet. A fixing device 25, which is configured to fix the transferred image on the sheet, is arranged on the side of the secondary image transferer 22. The fixing device 25 includes a fixing belt 26 which is an endless belt, and a pressure roller 27 which is arranged so as to be pressed by the fixing belt 26. The secondary transferer 22 also has a function of transporting the sheet of transferred image onto the fixing device 25. In FIG. 1, below the secondary transferer 22 and the fixing device 25, a sheet reverser 28 reversing the sheet to form an image on both sides thereof is located in parallel with the tandem image forming section 20.

When this color electrophotographic image forming apparatus is used to make a copy, a document is placed on a document platen 30 of the automatic document feeder (ADF) 400. Alternatively, the automatic document feeder (ADF) 400 is opened, a document is placed on a contact glass 32 of a scanner 300, and the automatic document feeder (ADF) 400 is closed to press the document. When pushing a start switch (not illustrated), the document placed on the automatic document feeder 400 is transported onto the contact glass 32. When the document is initially placed on the contact glass 32, by pushing the start switch (not illustrated), the scanner 300 is immediately driven to operate a first carriage 33 and a second carriage 34. Light is applied from a light source to the document by action of the first carriage 33, and reflected light from the document is further reflected toward the second carriage 34. The reflected light is further reflected by a mirror of the second carriage 34 and passes through an image-forming lens 35 into a read sensor 36 to thereby read the color document (color image). When a start switch (not illustrated) is pushed, a drive motor (not illustrated) rotates one of the suspension rollers 14, 15 and 16 such that the other two rollers are driven to rotate, to rotate and transport the intermediate transfer member 10. At the same time, each of the image forming units 18 rotates the photoconductor 40 and forms a single-colored (monochrome) image, i.e., a black image, a yellow image, a magenta image and cyan image on each photoconductor 40. The single-colored images are sequentially transferred onto the intermediate transfer member 10 to form a full-color image thereon.

Then, as the intermediate transfer member 10 is transported, these single-color images are sequentially transferred onto the intermediate transfer member 10 to form a composite color image thereon. On the other hand, when start switch (not illustrated) is pushed, one of paper feeding rollers 42 of paper feeding table 200 is selectively rotated to take a sheet out of one of multiple-stage paper cassettes 44 in a paper bank 43. A separation roller 45 separates sheets one by one and feed the sheet into a paper feeding route 46, and a feeding roller 47 feeds the sheet into a paper feeding route 48 of the copier 100 to be stopped against a registration roller 49. Then, in timing with a synthesized full-color image on the intermediate transfer member 10, the registration roller 49 is rotated to feed the sheet between the intermediate transfer member 10 and the second transferer 22, and the secondary image transferer 22 transfers the full-color image onto the sheet. The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 on the paper ejection tray 57. Meanwhile, the intermediate transfer member 10 after transferring an image is cleaned by the intermediate transfer member cleaner 17 to remove a residual toner thereon after the image is transferred, and ready for another image formation by the tandem image former 20.

In the above-mentioned tandem image forming section 20, each of the image forming units 18 includes a charger 60, an image developing device 61, a primary image transferer 62, a photoconductor cleaner 63, a charge elimination device 64, etc. around a drum-shaped photoconductor 40. The photoconductor cleaner 63 includes at least a blade cleaning member.

[Image Forming Method]

The image forming method of the present invention includes at least a charging step of charging a surface of a latent electrostatic image bearing member, an exposing step of exposing the charged surface of the latent electrostatic image bearing member to form a latent electrostatic image, a developing step of developing the latent electrostatic image using a developer to form a visible image, a transferring step of transferring the visible image onto a recording medium, and a fixing step of fixing the transferred image on the recording medium. As the developer, a developer containing the image forming toner of the present invention is used.

The image forming toner of the present invention can also be housed in a process cartridge which includes at least the latent electrostatic image bearing member and a developing unit and which is detachably mounted on a main body of an image forming apparatus.

Figure 2:
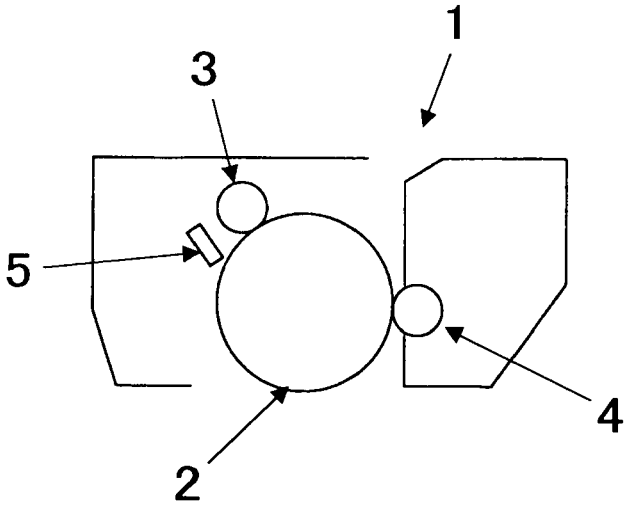
FIG. 2 is a diagram illustrating one example of a process cartridge according to the present invention.

FIG. 2 illustrates an image forming apparatus provided with a process cartridge of the present invention using the image forming toner of the present invention.

In FIG. 2, numeral 1 denotes the entirety of a process cartridge, which includes a photoconductor 2, a charging unit 3, a developing unit 4 and a cleaning unit 5.

In the present invention, two or more of the above-mentioned components of the photoconductor 2, charging unit 3, developing unit 4, cleaning unit 5, etc. are integrally combined to form a process cartridge, and the process cartridge is detachably mounted on a main body of an image forming apparatus such as copiers and printers.

The following describes operation of the image forming apparatus equipped with the process cartridge including the image forming toner of the present invention.

The photoconductor 2 is driven to rotate at a given circumferential speed. A peripheral surface of the photoconductor 2 is positively or negatively charged uniformly by a charger 3 while the photoconductor 2 is rotating to have a predetermined potential. Next, the photoconductor 2 receives an imagewise light from an irradiator, such as a slit irradiator and a laser beam scanner to form an latent electrostatic image on the peripheral surface thereof. Then, the latent electrostatic image is developed by an image developing unit 4 with a toner to form a toner image. Next, the toner image is transferred onto a transfer material fed between the photoconductor 2 and a transferer from a paper feeder in synchronization with the rotation of the photoconductor. Then, the transfer material which received the toner image is separated from the surface of the photoconductor and led to an image fixing unit to form a copy image which is ejected out of the apparatus. The surface of the photoconductor 2 is cleaned by a cleaner to remove a residual toner after transfer, and is discharged to repeat forming images.

EXAMPLES

Hereinafter, the present invention will be further described with reference to Examples, which shall not be construed as limiting the scope of the present invention. In the descriptions in the following examples, "part(s)" mean "part(s) by mass".

Production Examples 1 and 2

Production of Resin (b)

In an autoclave reaction vessel equipped with a thermometer, a stirrer and a nitrogen inlet tube, the materials shown in the column of "Polyester Diol (b11)" of Table 1, 2 parts of 2-ethylhexyl tin were charged and subjected to a ring-opening polymerization reaction at 160° C. under normal pressure for 3 hours, the reaction product was further reacted at 130° C. under normal pressure. The resin taken out from the reaction vessel was cooled to the room temperature, and then pulverized into particles to obtain Polyester Diols (b-11)-1 and (b-11)-2 each containing a polyhydroxycarboxylic acid skeleton. Next, the materials shown in the column "Polyester Diol (b12) of Table 1 were dehydration-condensed to obtain Polyester Diols (b12)-1 and (b12)-2. Then, Polyester Diol (b12)-1 and Polyester Diol (b-11)-1 were dissolved in methylethylketone. Polyester Diol (b-12)-2 and Polyester Diol (b-11)-2 were dissolved in methylethylketone. Subsequently, IPDI provided as a chain-extending agent was added to each of the resultant solutions to perform an extension reaction at 50° C. for 6 hours, followed by distillation of the solvent, thereby obtaining [Resin b-1] and [Resin b-2] of Production Examples 1 and 2.

TABLE 1

| | Resin (b-1) | | | | | |
|---|---|---|---|---|---|---|
| | Polyester Diol (b11) | | | | Polyester Diol (b12) | |
| | 1,3-propanediol (part by mass) | 1,4-butanediol (part by mass) | L-lactide (part by mass) | D-lactide (part by mass) | EO (2 mol) adduct of bisphenol A (part by mass) | Terephthalic acid (part by mass) |
| Resin b-1 | 2 | 0 | 54 | 14 | 15 | 15 |
| Resin b-2 | 0 | 2 | 50 | 13 | 17.5 | 17.5 |

Production Examples 3 and 4

Production of Resin (b)

L-lactide, D-lactide, ϵ-caprolactone, and tin octylate were each added in an amount of the parts by mass shown in Table 2 into a four-necked flask and then heated and melted at a temperature of 190° C. for 20 minutes under a nitrogen atmosphere. Thereafter, residual lactide and caprolactone were distilled away under reduced pressure, thereby obtaining [Resin b-3] and [Resin b-4].

TABLE 2

| | L-lactide (part by mass) | D-lactide (part by mass) | ϵ-caprolactone (part by mass) | octyltin (part by mass) |
|---|---|---|---|---|
| Resin b-3 | 80 | 20 | 10 | 1 |
| Resin b-4 | 70 | 30 | 5 | 1 |

—Synthesis of Polyester Prepolymer—

In a reaction vessel equipped with a condenser, a stirrer and a nitrogen inlet tube, 720 parts of ethylene oxide (2 mol) adduct of bisphenol A, 90 parts of propylene oxide (2 mol) adduct of bisphenol A, 290 parts of terephthalic acid, 25 parts trimellitic anhydride and 2 parts of dibutyltin oxide were charged and reacted under normal pressure at 230° C. for 8 hours. Then, the reaction product was further reacted under reduced pressure of 10 mmHg to 15 mmHg for 7 hours to synthesize an intermediate polyester resin. The resulting intermediate polyester resin was found to have a number average molecular weight (Mn) of 2,500, a weight average molecular weight (Mw) of 10,700, a peak molecular weight of 3,400, a glass transition temperature (Tg) of 57° C., an acid value of 0.4 mgKOH/g, and a hydroxyl value of 49 mg KOH/g.

Next, in a reaction vessel equipped with a condenser, a stirrer and a nitrogen inlet tube, 400 parts of an intermediate polyester resin, 95 parts of isophorone diisocyanate and 580 parts of ethyl acetate were charged and reacted at 100° C. for 8 hours to synthesize [Polyester Prepolymer]. The resulting polyester prepolymer was found to have a free isocyanate content of 1.42% by mass.

—Synthesis of Ketimine Compound—

In a reaction vessel equipped with a stirrer and a thermometer, 30 parts of isophorone diamine and 70 parts of methylethylketone were charged and then reacted at 50° C. for 5 hours to synthesize a ketimine compound. The resulting ketimine compound was found to have an amine value of 423 mgKOH/g.

—Preparation of Masterbatch—

Water (1,000 parts), carbon black (530 parts) having a DBP oil absorption of 42 mL/100 g and a pH of 9.5 (PRINTEX 35, produced by Degussa HULS AG) and 1,200 parts of the resin were mixed by a HENSCHEL MIXER (manufactured by Mitsui Mining Co., Ltd.). The resulting mixture was kneaded with a two-roll at 150° C. for 30 minutes, then rolled and cooled, and pulverized with a pulverizer (manufactured by Hosokawa Micron Co., Ltd.), thereby preparing a masterbatch.

Production Example 5

Production of Resin (a)

A mixture containing terephthalic acid (1,578 parts), isophthalic acid (83 parts), ethylene glycol (374 parts) and neopentyl glycol (730 parts) was heated in an autoclave at 260° C. for 2.5 hours to perform an esterification reaction. Next, germanium dioxide (0.262 parts) was added as a catalyst into the mixture. The temperature of the system was raised to 280° C. over 30 minutes, and then the pressure of the system was gradually reduced so that it reached 0.1 Torr after 1 hour. The polycondensation reaction was further continued under this condition. After 1.5 hours, the system was returned to normal pressure using a nitrogen gas, and the temperature thereof was reduced until it reached 260° C. Immediately after the reduction of the temperature of the system, isophthalic acid (50 parts) and trimellitic anhydride (38 parts) were added thereto, and the system was stirred at 255° C. for 30 minutes, and formed into a sheet-shape. The sheet-shaped product was sufficiently cooled to the room temperature and then crushed by a crusher, followed by filtering, thereby obtaining a polyester resin [Resin a-1] in each fraction of 1 mm to 6 mm. Analytical results of [Resin a-1] are shown in Table 3.

Production Examples 6 and 7

Production of Resin (a)

Two types of polyester resins were obtained through the same manner as described in [Resin a-1], which were designated as [Resin a-2] and [Resin a-3]. Analytical results thereof are shown in Table 3.

TABLE 3

| | | Resin a No. | | |
|---|---|---|---|---|
| | | Resin a-1 | Resin a-2 | Resin a-3 |
| Acid component | terephthalic acid (mol) | 95.1 | 67.8 | 70.1 |
| | isophthalic acid (mol) | 8 | 32.9 | 15.9 |
| | trimellitic acid (mol) | 2 | 21 | 0 |
| | phthalic acid (mol) | 0 | 0 | 1.5 |
| | adipic acid (mol) | 0 | 0 | 14.8 |
| Alcohol component | ethylene glycol (mol) | 44.3 | 39.8 | 44.4 |
| | neopentyl alcohol (mol) | 55.7 | 60.2 | 55.7 |

TABLE 3-continued

| | | Resin a No. | | |
|---|---|---|---|---|
| | | Resin a-1 | Resin a-2 | Resin a-3 |
| Properties | Acid value (mgKOH/g) | 30.3 | 22.3 | 10.9 |
| | Weight average molecular weight Mw | 9,800 | 13,500 | 19,000 |
| | Relative viscosity | 1.28 | 1.33 | 1.34 |
| | Glass transition temperature (° C.) | 68 | 63 | 50 |

Production Example 8

Production of Fine Particle Dispersion Liquid (w)

In a 2 L-glass container equipped with a jacket, 200 parts of [Resin a-1], 35 parts of ethylene glycol mono-n-butyl ether, 459 parts of a 0.5 weight % aqueous solution (hereinafter, referred to as PVA-1) of polyvinyl alcohol (produced by UNITIKA Ltd. "UNITIKA POVAL" 050G) and N,N-dimethyl ethanol amine (hereinafter, referred to as DMEA) in an amount equivalent to 1.2 times of the entire carboxyl groups contained in the polyester resin were charged. These components were stirred at 6,000 rpm, open to the air, using a desktop type Homo Disper (manufactured by Tokush Kikai Kogyo Co. Ltd., T.K. ROBOMIX). As a result, there was no precipitation of resin granules at the bottom of the container, and the mixed components were found to be completely suspended in the contained. Ten minutes later, hot water was passed through the jacket with this state maintained to heat the mixture. When the temperature inside the container reached 68° C., the mixture was stirred at 7,000 rpm, and further stirred for 20 minutes while the temperature inside the container being maintained at 68° C. to 70° C., thereby obtaining a uniform, white-milky aqueous dispersion. The aqueous dispersion was cooled to the room temperature by passing cold water through the jacket, while being stirred at 3500 rpm, followed by filtration using a stainless-steel filter (635 mesh, plain weave). As a result, almost no resin particles remained on the filter. Analytical results of the resulting filtrate (Fine Particle Dispersion Liquid w-1) are shown in Table 4.

Production Examples 9 and 10

Production of Fine Particle Dispersion Liquid (w)

Fine particle dispersion liquids were produced in the same manner as in Production Example 8, except that the amounts of the components were changed to those shown in Table 4. The fine particle dispersion liquids were designated as (Fine Particle Dispersion Liquid w-2) and (Fine Particle Dispersion Liquid w-3).

TABLE 4

| | Components of Dispersion Liquid | | | | | | Properties | |
|---|---|---|---|---|---|---|---|---|
| | Resin a | | N,N-dimethyl ethanol amine (eq./—COOH) | triethyl amine (eq./—COOH) | ethylene glycol mono-n-butyl ether (part by mass) | PVA-1 (part by mass) | Solid content concentration (%) | Volume average particle diameter (μm) |
| | No. | (part by mass) | | | | | | |
| *FPDL w-1 | Resin a-1 | 200 | 1.2 | 0 | 35 | 459 | 29.8 | 0.11 |
| *FPDL w-2 | Resin a-2 | 200 | 0 | 1.2 | 37 | 460 | 29.7 | 0.12 |
| *FPDL w-2 | Resin a-3 | 200 | 1.3 | 0 | 45 | 470 | 28.9 | 0.11 |

*FPDL: Fine Particle Dispersion Liquid

Production Example 11

Production of Fine Particle Dispersion Liquid (w-4)

Into a reaction vessel equipped with a stirrer and a thermometer, 600 parts of water, 120 parts of styrene, 100 parts of methacrylic acid, 45 parts of butyl acrylate, 10 parts of sodium alkyl allyl sulfosuccinate (ELEMINOL JS-2, produced by Sanyo Chemical Industries, Ltd.) and 1 part of ammonium persulfate were charged, and stirred at 400 rpm for 20 minutes to obtain a white liquid emulsion. Then, the temperature of the system was raised to 75° C. by heating and reacted for 6 hours. Further, 30 parts of a 1% ammonium persulfate aqueous solution was added to the system and aged at 75° C. for 6 hours to thereby obtain an aqueous dispersion liquid of vinyl resin (copolymer of styrene methacrylate-butyl methacrylate-sodium alkyl allyl sulfosuccinate) [Fine Particle Dispersion Liquid w-4]. The volume average particle diameter of [Fine Particle Dispersion Liquid w-4] was measured by ELS-800 and found to be 0.08 μm. A part of [Fine Particle Dispersion Liquid w-4]. was dried so that resin parts were isolated therefrom. The glass transition temperature of the resin parts measured by a flow tester was 74° C.

Production Example 12

Preparation of Aqueous Medium

Ion exchanged water (300 parts), [Fine Particle Dispersion Liquid w-1] (300 parts) and sodium dodecylbenzene sulfonate (0.2 parts) were mixed and stirred so as to be uniformly dissolved, thereby preparing [Aqueous Medium Phase 1].

Production Example 13

Preparation of Resin Solution

Into the reaction vessel, [Resin b-1] to [Resin b-4], [Polyester prepolymer] each in an amount of the parts shown in Table 5 and 80 parts of ethyl acetate were added and stirred to prepare resin solutions 1 to 4.

TABLE 5

| | Resin b | | Polyester (prepolymer) |
|---|---|---|---|
| | Resin b No. | Formulated amount (part by mass) | Formulated amount (part by mass) |
| Resin Solution 1 | Resin b-1 | 85 | 15 |
| Resin Solution 2 | Resin b-2 | 80 | 20 |
| Resin Solution 3 | Resin b-3 | 100 | 0 |
| Resin Solution 4 | Resin b-4 | 100 | 0 |

Production Example 14

Preparation of Emulsion

Next, in each of the resin solutions 1 to 4, carnauba wax (molecular weight: 1,800, acid value: 2.7 mgKOH/g, rate of penetration: 1.7 mm (40° C.)) (5 parts) and the masterbatch (5 parts) were added and passed three times through a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume, so that the materials were dissolved in each of the resin solutions 1 to 4. Further, the ketimine compound (2.5 parts) was added to the solution to obtain a toner material liquid.

Next, into the vessel, 150 parts of [Aqueous Medium Phase 1] were poured, and while the medium being stirred at 12,000 rpm by a TK-type homomixer (manufactured by Tokush Kikai Kogyo Co., Ltd.), 100 parts by mass of the toner material liquid was added thereto and mixed for 10 minutes to obtain an emulsion slurry. Further, into a kolben equipped with a stirrer and a thermometer, 100 parts by mass of the emulsion slurry were added, and the solvent was removed at 30° C. for 10 hours while stirring at a stirring circumferential speed of 20 m/min thereby obtaining a dispersion slurry.

Next, 100 parts by mass of the dispersion slurry were filtered under reduced pressure, and 100 parts by mass of ion exchanged water were added to the resulting filtration cake and mixed at 12,000 rpm for 10 minutes using a TK homomixer, followed by a filtration treatment. Into the resulting filtration cake, 300 parts of ion exchanged water were added, mixed at 12,000 rpm for 10 minutes using a TK homomixer and then filtered twice. Into the resulting filtration cake, 20 parts of 10% by mass sodium hydroxide aqueous solution were added, mixed at 12,000 rpm for 30 minutes using a TK homomixer, and filtered under reduced pressure. Into the resulting filtration cake, 300 parts of ion exchanged water were added, mixed at 12,000 rpm for 10 minutes using a TK homomixer. Into the resulting filtration cake, 300 parts of ion exchanged water were added, mixed at 12,000 rpm for 10 minutes using a TK homomixer and then filtered twice. Into the resulting filtration cake, 20 parts of 10% by mass hydrochloric acid were added, mixed at 12,000 rpm for 10 minutes using a TK homomixer. Subsequently, into the resulting filtration cake, a fluorine-containing quaternary ammonium salt compound, FTERGENT F-310 (produced by Neos Co., Ltd. was added, in the form of a 5% methanol solution, so that the fluorine-containing quaternary ammonium salt was contained in an amount equal to 0.1 parts with respect to 100 parts of solid contents of the toner, followed by stirring for 10 minutes and then filtering. Into the resulting filtration cake, 300 parts of ion exchanged water were added, mixed at 12,000 rpm for 10 minutes using a TK homomixer, and then filtered twice, thereby obtaining a final filtration cake. The final filtration cake was dried with a circular air-drier at 40° C. for 36 hours and sieved with a mesh with openings of 75 μm, thereby producing toner base particle 1.

Toner base particles 2 to 10 were each produced in the same manner as in Production Example 14, except that the type of resin b, the formulation amount of the resin b, the formulation amount of prepolymer, and the type of Fine Particle Dispersion Liquid were changed as shown in Table 6.

TABLE 6

| | | Composition of Resin Solution | | | |
|---|---|---|---|---|---|
| | Resin | Resin b | | Polyester b2 | Fine Particle Dispersion |
| Toner base particle No. | solution No. | Type | (part by mass) | (Prepolymer) (part by mass) | Liquid Resin No. |
| Toner base particle 1 | Resin solution 1 | Resin b-1 | 85 | 15 | Fine Particle Dispersion Liquid Resin w-1 |
| Toner base particle 2 | Resin solution 1 | Resin b-1 | 85 | 15 | Fine Particle Dispersion Liquid Resin w-2 |
| Toner base particle 3 | Resin solution 1 | Resin b-1 | 85 | 15 | Fine Particle Dispersion Liquid Resin w-3 |
| Toner base particle 4 | Resin solution 2 | Resin b-2 | 80 | 20 | Fine Particle Dispersion Liquid Resin w-1 |
| Toner base particle 5 | Resin solution 3 | Resin b-3 | 100 | 0 | Fine Particle Dispersion Liquid Resin w-1 |
| Toner base particle 6 | Resin solution 3 | Resin b-3 | 100 | 0 | Fine Particle Dispersion Liquid Resin w-2 |
| Toner base particle 7 | Resin solution 3 | Resin b-3 | 100 | 0 | Fine Particle Dispersion Liquid Resin w-3 |
| Toner base particle 8 | Resin solution 4 | Resin b-4 | 100 | 0 | Fine Particle Dispersion Liquid Resin w-1 |
| Toner base particle 9 | Resin solution 1 | Resin b-1 | 85 | 15 | Fine Particle Dispersion Liquid Resin w-4 |
| Toner base particle 10 | Resin solution 3 | Resin b-3 | 100 | 0 | Fine Particle Dispersion Liquid Resin w-4 |

—Production of Toner—

Each of the resulting toner base particles 1 to 10 (100 parts) and a hydrophobic silica (1.0 part) serving as an external additive (H2000, produced by Clariant Japan K.K.) were mixed by a HENSCHEL MIXER (manufactured by Mitsui Mining Co., Ltd.) at a circumferential speed of 30 m/sec for 30 seconds and the mixing was stopped for 1 minute, and this process was repeated 5 times. After that, the mixed product was then sieved with a mesh with openings of 35 μm, thereby producing Toners 1 to 10.

—Production of Carrier—

Into 100 parts of toluene, 100 parts of a silicone resin (organo straight silicone), 5 parts of γ-(2-aminoethyl)aminopropyl trimethoxysilane, and 10 parts of carbon black were added, dispersed for 20 minutes using a homomixer to prepare a resin layer coating liquid. The resin layer coating liquid was applied on a surface of a spherically shaped magnetite (1,000 parts) having a volume average particle diameter of 50 μm, using a fluidized bed coater, to thereby produce a carrier.

—Production of Developer—

Each of the Toners 1 to 10 (5 parts) and the carrier (95 parts) were mixed to produce developers of Examples 1 to 8 and Comparative Examples 1 and 2.

Next, the resulting developers were each evaluated for their fixability, heat resistant storage stability and haze degree in the following manners. The evaluation results are shown in Table 7.

<Fixability>

In an electrophotographic copier (MF-200, manufactured by Ricoh Company Ltd.) using a Teflon™ roller as a fixing roller, its fixing unit was remolded for use in evaluation on fixability of toner. Using the electrophotographic copier, a solid image was formed, with a toner-adhesion amount of 0.85 mg/cm$^2$±0.1 mg/cm$^2$, on regular paper and heavy paper, i.e., transfer paper Type 6200 (produced by Ricoh Company Ltd.) and copy-printing paper <135> (produced by NBS Ricoh Co., Ltd.). On that occasion, a maximum limit temperature at which no hot offset had occurred on the regular paper was determined as a maximum limit fixing temperature. A minimum limit temperature at which the residual ratio of the image density after the solid image formed on the heavy paper been rubbed with a pad became 70% or more was determined as a minimum limit fixing temperature.

[Evaluation Criteria of Maximum Limit Fixing Temperature]

A: The maximum limit fixing temperature was 190° C. or higher.

B: The maximum limit fixing temperature was 180° C. or higher and lower than 190° C.

C: The maximum limit fixing temperature was 170° C. or higher and lower than 180° C.

D: The maximum limit fixing temperature was lower than 170° C.

[Evaluation Criteria of Minimum Limit Fixing Temperature]

A: The minimum limit fixing temperature was lower than 135° C.

B: The minimum limit fixing temperature was 135° C. or higher and lower than 145° C.

C: The minimum limit fixing temperature was 145° C. or higher and lower than 155° C.

D: The minimum limit fixing temperature was 155° C. or higher.

<Image Density>

Using a tandem type color image forming apparatus (IMAGIO NEO 450, manufactured by Ricoh Company Ltd.), a solid image was formed, with a toner-adhesion amount of 1.00 mg/cm$^2$±0.05 mg/cm$^2$, on copy-printing paper TYPE 6000<70 W> (produced by Ricoh Company Ltd.), while the surface temperature of the fixing roller being controlled to 160° C.±2° C. Image densities of arbitrarily selected six portions of the formed solid image were measured using a spectrometer (938 Spectrodensitometer, manufactured by X-Rite) to determine the average image density, followed by evaluation according to the following criteria.

[Evaluation Criteria]

A: The image density was 2.0 or higher.

B: The image density was 1.70 or higher and lower than 2.0.

C: The image density was lower than 1.70.

<Haze Degree>

As image samples for use in evaluation of fixability of toner, monochrome image samples were developed on OHP sheets, Type PPC-DX (produced by Ricoh Company Ltd.) with the temperature of the fixing belt being set at 160° C. The haze degree of each of the monochrome image samples was read and measured by a direct-reading haze measuring computer (Model HGM-2DP, manufactured by Suga Tester Co., Ltd.). Haze degree is also called "degree of cloudiness" and measured as an indicator showing the transparency of toner. The lower the haze value, the higher the transparency of the toner is, and when OHP sheet is used, excellent color developing ability is exhibited.

[Evaluation Criteria]

A: The haze degree was less than 20%.

B: The haze degree was 20% or more and less than 30%.

C: The haze degree was 30% or more.

<Environmental Stability>

Each of the developers was stirred using a ball mill for 5 minutes in an environment having a temperature of 23° C. and a relative humidity of 50% (M/M environment), and then sampled in an amount of 1.0 g. The samples were blown dry with nitrogen gas for 1 minute using a blow-off charge amount measurement device (TB-200, manufactured by Kyocera Chemical Corporation) to measure the charged amount. The measurement of charged amounts of each of the developers was performed for evaluation under the following two environmental conditions, i.e., at a temperature 40° C. and a relative humidity 90% (H/H environment); and at a temperature 10° C. and a relative humidity 30% (L/L environment). A degree of environmental variability was calculated based on the following equation. It can be said that the lower the degree of environmental variability, the more stable chargeability the developer has.

[Evaluation Criteria]

A: The degree of environmental variability was less than 10%.

B: The degree of environmental variability was 10% or more and less than 30%.

C: The degree of environmental variability was 30% or more and less than 50%.

D: The degree of environmental variability was 50% or more.

TABLE 7

| | | Dv (μm) | Dn (μm) | Dv/Dn | Minimum limit fixing temperature | Maximum limit fixing temperature | Image density | Haze degree | Degree of environmental variability |
|---|---|---|---|---|---|---|---|---|---|
| Ex. 1 | Toner 1 | 5.5 | 4.8 | 1.15 | A | A | A | A | B |
| Ex. 2 | Toner 2 | 5.5 | 4.6 | 1.20 | A | A | A | A | A |
| Ex. 3 | Toner 3 | 5.4 | 4.6 | 1.17 | A | A | A | A | A |
| Ex. 4 | Toner 4 | 5.2 | 4.3 | 1.21 | A | B | A | A | B |
| Ex. 5 | Toner 5 | 5.6 | 4.8 | 1.17 | A | A | A | A | B |
| Ex. 6 | Toner 6 | 5.6 | 4.5 | 1.24 | A | A | A | A | A |
| Ex. 7 | Toner 7 | 5.5 | 4.5 | 1.22 | A | A | A | A | A |
| Ex. 8 | Toner 8 | 5.8 | 4.6 | 1.26 | A | B | A | A | B |
| Comp. Ex. 1 | Toner 9 | 5.5 | 4.6 | 1.20 | B | B | A | A | D |

TABLE 7-continued

| | | Dv (μm) | Dn (μm) | Dv/Dn | Minimum limit fixing temperature | Maximum limit fixing temperature | Image density | Haze degree | Degree of environmental variability |
|---|---|---|---|---|---|---|---|---|---|
| Comp. Ex. 2 | Toner 10 | 5.4 | 4.4 | 1.23 | B | B | A | A | D |

A toner containing, in its surface, a resin particle having a polyhydroxy carboxylic acid skeleton and to which surface a polyester resin composed of a polybasic acid and a polyhydric alcohol is attached, had excellent fixability, high image density, low haze degree and excellent environmental variability. A toner having a surface to which an unsuitable resin had been attached was found to be inferior in environmental variability (environmental stability).

The image forming toner of the present invention is superior in thermal properties (especially in low-temperature fixability) and can produce excellent high-quality images and thus can be suitably used as a toner for use in electrophotographic image formation using copiers, electrostatic printing, printers, facsimiles, electrostatic recording, etc.

What is claimed is:

1. An electrostatic image developing toner comprising:

a toner particle (C), wherein the toner particle (C) has a structure in which a resin particle (A) containing at least a first resin (a) or a coated film (P) containing the first resin (a) is attached to a surface of a resin-containing particle (B) containing a second resin (b), and wherein the resin (b) includes a polyhydroxycarboxylic acid skeleton, and the resin (a) is a polyester resin formed from a polybasic acid and a polyhydric alcohol, wherein the resin (b) contains a linear polyester (b1) obtained by reacting a polyester diol (b11) containing a polyhydroxycarboxylic acid skeleton with a polyester diol (b12), wherein polyester diol (b12) is a reaction product between a diol and a dicarboxylic acid, in the presence of a chain-extending agent selected from the group consisting of diisocyanate compounds and dicarboxylic acid compounds.

2. The electrostatic image developing toner according to claim 1, wherein the polybasic acid is at least one of an aromatic dicarboxylic acid, an aliphatic dicarboxylic acid and an alicyclic dicarboxylic acid.

3. The electrostatic image developing toner according to claim 2, wherein the aromatic dicarboxylic acid is selected from terephthalic acid, isophthalic acid, orthophthalic acid, naphthalene dicarboxylic acid, and biphenyl dicarboxylic acid.

4. The electrostatic image developing toner according to claim 2, wherein the aliphatic dicarboxylic acid is selected from oxalic acid, succinic acid, succinic anhydride, adipic acid, azelaic acid, sebacic acid, dodecanedioic acid, hydrogenated dimer acid, fumaric acid, maleic acid, maleic anhydride, itaconic acid, itaconic anhydride, citraconic acid, citraconic anhydride, and dimer acid.

5. The electrostatic image developing toner according to claim 2, wherein the alicyclic dicarboxylic acid is selected from 1,4-cyclohexanedicarboxylic acid, 1,3-cyclohexanedicarboxylic acid, 1,2-cyclohexanedicarboxylic acid, 2,5-norbornenedicarboxylic acid, 2,5-norbornenedicarboxylic anhydride, tetrahydrophthalic acid, and tetrahydrophthalic anhydride.

6. The electrostatic image developing toner according to claim 1, wherein the polyhydric alcohol is at least one of an aliphatic glycol having 2 to 10 carbon atoms, an alicyclic glycol having 6 to 12 carbon atoms, and an ether bond-containing glycol.

7. The electrostatic image developing toner according to claim 1, wherein the resin (b) includes a polyhydroxycarboxylic acid skeleton obtained from an optically active monomer, the polyhydroxycarboxylic acid skeleton has an optical purity X, calculated on the monomer basis, of 80% or less, and the optical purity X is determined from the following equation, $$\text{Optical Purity } X(\%)=|X(L\text{-form})-X(D\text{-form})$$

where X (L-form) represents, calculated on the monomer basis, an L form ratio (mol %), and X (D-form) represents, calculated on the monomer basis, a D form ratio (mol %).

8. The electrostatic image developing toner according to claim 1, wherein the polyhydroxycarboxylic acid skeleton contained in the resin (b) is a skeleton obtained by polymerization or copolymerization of a lactic acid.

9. The electrostatic image developing toner according to claim 1, wherein the polyhydroxycarboxylic acid skeleton contained in the resin (b) is a skeleton obtained by ring-opening polymerization of lactide.

10. The electrostatic image developing toner according to claim 1, wherein the polyhydroxycarboxylic acid skeleton contained in the resin (b) is a skeleton obtained by ring-opening polymerization of a mixture of L-lactide and D-lactide.

11. The electrostatic image developing toner according to claim 1, wherein the polyhydroxycarboxylic acid skeleton contained in the resin (b) is a skeleton obtained by copolymerization of a hydroxycarboxylic acid having 2 to 6 carbon atoms.

12. The electrostatic image developing toner according to claim 11, wherein the hydroxycarboxylic acid having 2 to 6 carbon atoms is any one of glycolic acid, lactic acid, glycolide, and lactide.

13. The electrostatic image developing toner according to claim 1, wherein a mass ratio of the polyester diol (b11) to the polyester diol (b12) is 31:69 to 90:10.

14. The electrostatic image developing toner according to claim 1, wherein the polyester resin of the first resin (a) has an acid value of 10 mgKOH/g to 40 mgKOH/g.

15. The electrostatic image developing toner according to claim 1, wherein the first resin (a) is a polyester resin containing a basic compound.

16. A developer comprising:

an electrostatic image developing toner according to claim 1, and a carrier.

17. An image forming method comprising:

charging a surface of a latent electrostatic image-bearing member, exposing the charged surface of the latent electrostatic image-bearing member to form a latent electrostatic image, developing the latent electrostatic image using a developer to form a visible image, transferring the visible image onto a recording medium, and fixing the transferred image on the recording medium, wherein the developer comprises an electrostatic image developing toner according to claim 1.

* * * * *